United States Patent [19]

Herten

[11] Patent Number: 4,596,349

[45] Date of Patent: Jun. 24, 1986

[54] MACHINE FOR APPLYING ARTICLES OF HARDWARE TO TEXTILE MATERIALS AND THE LIKE

[75] Inventor: Ernst Herten, Stolberg, Fed. Rep. of Germany

[73] Assignee: William Prym-Werke KG, Stolberg, Fed. Rep. of Germany

[21] Appl. No.: 729,616

[22] Filed: May 2, 1985

[51] Int. Cl.[4] ..... A41H 37/10

[52] U.S. Cl. ..... 227/18; 227/57; 227/119

[58] Field of Search ..... 227/18, 36, 120, 124, 227/119, 152, 153, 77, 57

[56] References Cited

U.S. PATENT DOCUMENTS

| | | | |
|---|---|---|---|
| 425,209 | 4/1890 | Carpenter | 227/18 |
| 4,135,287 | 1/1979 | Silverbush | 227/18 X |
| 4,278,194 | 7/1981 | Ersoy | 227/18 |

FOREIGN PATENT DOCUMENTS

| | | | |
|---|---|---|---|
| 2065448 | 7/1981 | United Kingdom | 227/152 |

*Primary Examiner*—James F. Coan

*Attorney, Agent, or Firm*—Peter K. Kontler

[57] ABSTRACT

Male or female annular components of fasteners are applied to articles of clothing in a machine wherein the lower tool of a pair of confronting tools has a socket for reception of the heads of discrete rivet-like connectors whose shanks extend upwardly toward the upper tool which has tongs with jaws for releasably holding a male or female component in such orientation that the central aperture of the component is in register with the shank of the connector in the socket of the lower tool. The upper tool further includes a ring-shaped hold-down device for the male or female component which is held by the tongs as well as a deforming plunger which can upset the tip of the shank after the latter has penetrated a garment between the two tools and thereupon through and partly beyond the aperture of the component in the tongs in response to downward movement of the upper tool. The hold-down device is movable axially relative to the tongs and the plunger is movable within limits axially of the hold-down device. The male and female components of fasteners are stored in discrete magazines and are fed to the tongs by devices whose operation can be blocked so that the tongs receive male or female components.

22 Claims, 21 Drawing Figures

FIG. 17
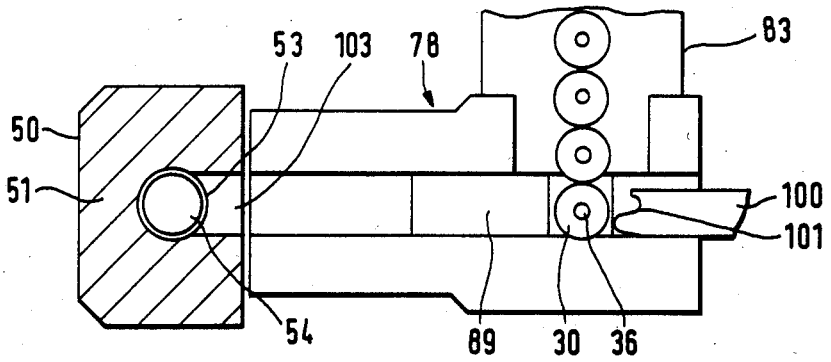
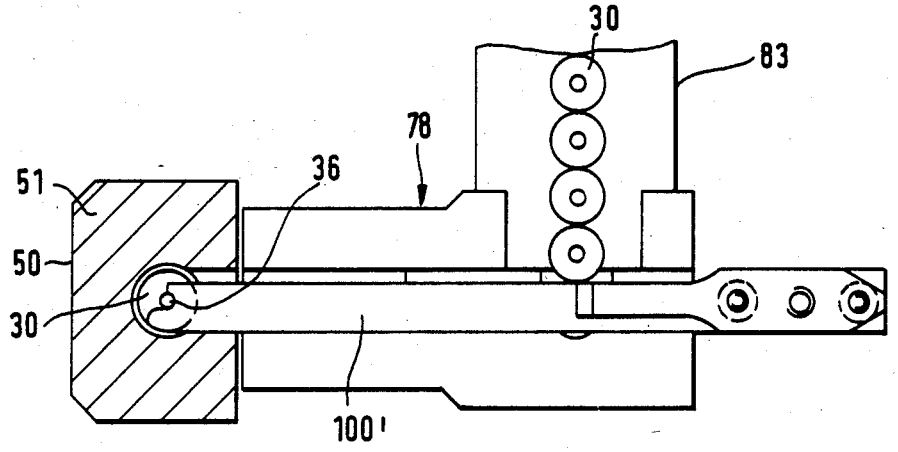
FIG. 18

MACHINE FOR APPLYING ARTICLES OF HARDWARE TO TEXTILE MATERIALS AND THE LIKE

CROSS-REFERENCE TO RELATED CASES

Snap fastener units similar to those which are treated in the riveting press of the present invention are disclosed in the commonly owned copending patent application Ser. No. 655,048 filed Sept. 26, 1984 by Bernhard Nysten et al. for "Snap fastener unit". Riveting presses which are somewhat similar to the riveting press of the present invention are disclosed in the commonly owned copending patent application Ser. No. 599,176 filed Apr. 11, 1984 by Ernst Herten for "Machine for applying articles of Hardware to textile materials and the like" and in the commonly owned copending patent application Ser. No. 599,172 filed Apr. 11, 1984 by Ernst Herten et al. for "Riveting press". An apparatus for feeding articles of hardware in riveting presses of the class to which the present invention belongs is disclosed in the commonly owned copending patent application Ser. No. 598,990 filed Apr. 11, 1984 by Paul Hagmann for "Apparatus for feeding articles of hardware in riveting presses and the like".

BACKGROUND OF THE INVENTION

The present invention relates to improvements in machines for applying components of fasteners to penetrable carriers, e.g., to panels, webs or sheets of textile or plastic material. More particularly, the invention relates to improvements in machines of the type wherein components of fasteners can be secured to carriers by means of rivet-shaped connectors. Such fasteners are often applied to jeans, jackets, shirts, blouses, overalls and/or other articles of apparel for utilitarian and/or decorative purposes.

As a rule, each fastener of the type whose components are to be treated in the machine of the present invention has a male component and a female component. The male component can be separably connected with the corresponding female component, e.g., to prevent access to a pocket, to hold down a collar, to button down the sleeve of a jacket or shirt, or for purely decorative purposes. The male and female components are applied to one side of the carrier opposite the respective connectors which have rivet heads located at the other side of the carrier as well as shanks which extend through the carrier and are deformed into more or less permanent engagement with the respective (male or female) components of fasteners. As a rule, the male and female components of fasteners are formed with centrally located apertures for the shanks of the respective connectors, and the tips of the shanks are upset so as to overlie portions of the exposed sides of the components to thereby prevent axial movements of the components and the respective connectors relative to each other as well as to securely clamp a portion of the carrier between each male or female component and the respective connector. The female components of fasteners have suitably configurated coupling elements which can be brought into engagement with complementary (i.e., different) coupling elements of the male components. The coupling elements can constitute annuli which extend from exposed sides of the respective (male and female) components, and the coupling element of a male component can penetrate (e.g., by snap action) into the coupling element of a female component to thus complete the assembly of a two-piece fastener. The coupling elements of the male and female components act not unlike male and female detent means and can exhibit a certain amount of resiliency so that they can remain in reliable engagement with one another but can be separated in response to the application of a requisite force.

Male and female components of the above outlined fasteners are assembled with rivet-like connectors in discrete riveting presses or analogous machines. A first press is used to assemble male components of fasteners with suitable connectors, and a second press is employed to assemble connectors with female components. Each press is normally provided with means for automatically feeding male or female components and connectors to the assembling station between two relatively movable confronting tools one of which supports the connector and the other of which supports the male or female component and is designed to deform the shank of the connector as soon as the latter assumes an optimum position with reference to the male or female component.

A drawback of such mode of applying male and female components of fasteners to articles of clothing or the like is that each garment must be treated in a first machine wherein the garment is provided with male or female components and thereupon in a discrete second machine wherein the garment is provided with female or male components of fasteners. The utilization of two discrete machines is deemed necessary because the female components of fasteners are not identical with the male components so that the application of male components necessitates the use of a first set of tools whereas the application of female components necessitates the use of a different second set of tools. The utilization of two discrete riveting presses or analogous machines not only contributes to initial and maintenance cost but also to the cost of the garments because the application of male and female components of fasteners in two different machines is a time-consuming operation. Proposals to replace a first set of tools with a different second set of tools in order to allow for the application of male and female components on one and the same machine have met with little success in the relevant industry because the conversion of a single machine for the application of male or female components is complex and takes up long intervals of time with attendant pronounced losses in output.

OBJECTS AND SUMMARY OF THE INVENTION

An object of the invention is to provide a riveting press or an analogous machine which is constructed and assembled in such a way that it can apply male or female components of fasteners to one and the same carrier without the need for a change of setup.

Another object of the invention is to provide a machine which can be used for the application of different types of male and/or female components of fasteners to articles of clothing or the like.

A further object of the invention is to provide a machine which can assemble male or female components of fasteners with one and the same type of connectors or with two or more different types of connectors without any changes in the setup.

An additional object of the invention is to provide a machine wherein one and the same set of tools can be used to assemble one or more types of male or female components of fasteners with one or more types of connectors.

Still another object of the invention is to provide a machine of the above outlined character with novel and improved tools which can be used for the application of male or female components of fasteners.

A further object of the invention is to provide novel and improved male and female components of fasteners for the application to articles of clothing or the like in a machine of the above outlined character.

An additional object of the invention is to provide novel and improved connectors for use in the above outlined machine as a means for securing male or female components of fasteners to carriers of penetrable textile or plastic material.

A further object of the invention is to provide novel and improved means for supplying male and female components of fasteners and connectors into the range of tools in a machine of the above outlined character.

Still another object of the invention is to provide a novel and improved method of attaching male or female components of fasteners to penetrable carriers which consist of a textile or like material.

Another object of the invention is to provide a machine whose output is much higher than the output of heretofore known batteries of machines for the application of male and female components of fasteners to articles of clothing or the like.

A further object of the invention is to provide the machine with novel and improved means for regulating the delivery of selected male and/or female components of fasteners and/or selected types of connectors into the range of tools which are used to assemble male or female components with rivet-like connectors.

An additional object of the invention is to provide the machine with novel and improved means for blocking the admission of unwanted components and/or connectors to the station where the selected components are attached to their carriers.

The invention is embodied in a machine for selectively applying centrally apertured annular male and female components of fasteners to penetrable carriers (especially to panels or sheets of textile material) by means of connectors of the type having a rivet head and a deformable shank which extends from one side of the rivet head. The machine comprises confronting first and second tools and means for moving one of the tools relative to the other tool between a retracted position in which a carrier can be inserted between the two tools and an extended position in which the tools cooperate to secure a connector to a male or female component, with a portion of the carrier therebetween. The first tool (which can be disposed at a level below the second tool) has a socket for reception of the heads of discrete connectors in such orientation that the shank of the connector in the socket extends toward the second tool and penetrates through the carrier between the two tools on movement of the one tool toward its extended position. The second tool comprises gripper means (e.g., a tongs with two jaws which are movable toward and away from each other) for releasably holding a male or female component in such orientation that the aperture of the component which is held by the gripper means registers with and receives the shank of the connector in the socket of the first tool in response to movement of the one tool toward the extended position. The second tool further comprises a deforming member which is movable with reference to the gripper means during movement of the one tool toward the extended position so as to deform the shank of the connector in the socket subsequent to penetration of such shank first through the carrier between the two tools and thereupon through and partially beyond the aperture of the male or female component which is held by the gripper means. The machine further comprises means for introducing discrete connectors into the socket in successive retracted positions of the one tool, and means for deliverying discrete male or female components to the gripper means in successive retracted positions of the one tool.

The second tool preferably further comprises a back support which serves to hold down the component which is held by the gripper means during penetration of the shank of a connector through and partly beyond the aperture of such component as well as during subsequent deformation of the shank.

The male and female components of fasteners preferably have at least substantially identically dimensioned outer marginal portions which are engageable by the gripper means, and the male and female components respectively have annular male and female coupling elements which face away from the first tool (namely toward the aforementioned back support) while the respective marginal portions are held by the gripper means. The first tool preferably includes a platform with a supporting surface for the carrier, and the socket is provided in the platform. Still further, the first tool preferably comprises a ram which is surrounded by the platform and has a surface serving to contact the other side of the head of the connector in the socket. The platform is movable relative to the ram to thereby vary the distance between the surface of the platform and the surface of the ram and to thus move the shank of the connector in the socket toward the respective side of the carrier overlying the surface of the platform.

The machine further comprises at least one source of connectors, means for feeding discrete connectors from the source into the range of the introducing means, at least one source of male components, at least one source of female components, and means for selectively feeding male and female components from the respective sources into the range of the delivering means. The delivering means can advance discrete male or female components between the jaws of the gripper means, and the deforming member of the second tool is preferably reciprocable with reference to the jaws of the gripper means and has a front end face which serves to deform the shank of a connector while such shank extends partially beyond the aperture of the component which is being held down by the back support of the second tool. The back support can comprise a ring and the deforming member preferably comprises or constitutes a plunger which is reciprocable axially within the confines of the ring. In accordance with a presently preferred embodiment of the improved machine, the ring is reciprocable within limits axially of the deforming member and has an annular end face which contacts the male or female component which is held by the gripper means during movement of the one tool toward the extended position so that the end face of the ring surrounds the aperture of such component. The end face of the ring is preferably formed with an annular groove which is bounded by a first and a second annular surface. The male coupling element of the male component which is held by the gripper means is in contact with and is held against deformation by one of the first and second annular surfaces during movement of the one tool toward its extended position and the female coupling element of a female component which is held by the gripper means is in contact with and is held against deformation by the other of the first and second annular surfaces during movement of the one tool toward its extended position. The first annular surface of the ring preferably surrounds the second annular surface, and the female coupling element of a female component which is held by the gripper means preferably contacts and is held against deformation by the first annular surface. The end face of the ring is preferably further formed with an annular recess which surrounds the aforementioned groove and receives the outer marginal portion of the male or female component which is held by the gripper means.

The machine preferably further comprises means for inactivating the feeding means for male components when the feeding means for the female components is active or operative and vice versa. The machine preferably also comprises means for receiving components from the source or sources of male components or from the source or sources of female components, and means for blocking the admission of components from n-1 sources while the receiving means receives components from the remaining (selected) source (n is the total number of sources of male and female components). The receiving means can be provided with a channel for reception of male or female components from a selected source, and the delivering means can comprise a pusher which is reciprocable in the channel and serves to transfer discrete components from the channel and into the space between the jaws of the gripper means.

The first tool preferably further comprises preferably tubular confining means (e.g., a metallic or plastic sleeve) which axially movably surrounds the ram and a coil spring or other suitable means for yieldably biasing the confining means in a direction toward the second tool to a position in which the confining means extends beyond the connector-engaging surface of the ram and surrounds the connector in the socket.

The second tool preferably further comprises means for limiting the extent of axial movability of the ring of the back support and the deforming member relative to each other (such limiting means can comprise an elongated slot in the ring and a radially extending pin provided on the deforming member and received in the slot). Still further, the second tool can comprise a package of dished springs or other suitable means for yieldably biasing the ring in a direction toward the first tool so that the ring normally assumes a predetermined (lower) end position with reference to the deforming member in which the deforming member is spaced apart from the male or female component which is held by the gripper means.

The machine can be equipped with several sources of different connectors (e.g., each such source can contain a supply of differently colored connectors) and means for feeding connectors from a selected source into the range of the introducing means. Such machine preferably further comprises means for blocking the admission of connectors from all but the selected source of connectors. The feeding means preferably includes a discrete feeding unit for each of the sources and means for receiving connectors from the selected source of connectors. The introducing means is then arranged to transfer connectors from the receiving means into the socket of the first tool. Such receiving means can comprise a channel which is dimensioned to receive different types of connectors, i.e., connectors from any selected source.

The male and female components of fasteners are preferably of the type having a convex side facing the connector in the socket of the first tool and a concave side facing the end face of the ring of the second tool when a male or female component is held by the gripper means, and the one side of the head of each connector is preferably a concave side. This entails a certain bulging of the carrier portion which is clamped between a male or female component and a connector when the component is adequately secured to the connector as a result of movement of the one tool to its extended position.

In order to enhance the versatility of the improved machine, the latter can comprise at least two sources of different male or female components (e.g., each such source can contain a supply of differently colored male or female components), at least one additional source of female or male components, discrete component feeding means for each source, means for receiving components from the feeding means, and means for activating one of the feeding means at a time so that the receiving means is supplied with components from one of the at least two sources or from the additional source. Each feeding means preferably comprises means for singularizing the respective male or female components and for supplying to the receiving means onc component at a time (not unlike the singularizing means which supplies discrete bottle caps from a source of randomly distributed caps to the cap applying station of a bottle capping machine).

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 17 is a fragmentary plan view of means for inserting discrete connectors into the socket of the lower tool, the means for actually introducing the connectors into the socket being shown in the retracted position;

FIG. 18 illustrates the structure of FIG. 17 but with the introducing means in extended position at the instant of insertion of a discrete connector into the socket of the lower tool;

DESCRIPTION OF THE PREFERRED EMBODIMENTS

Figure 2:
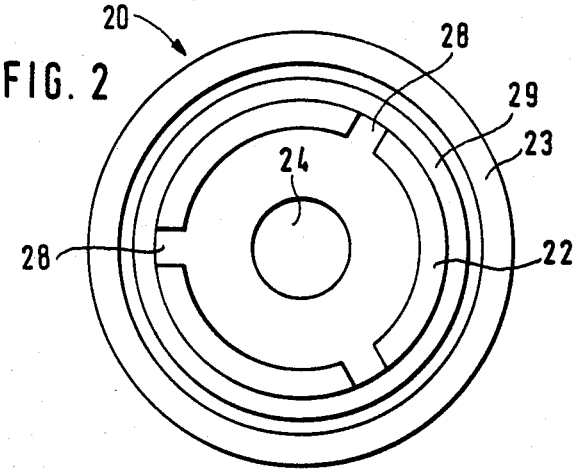
FIG. 2 is a bottom plan view of the female component which is shown in FIG. 1.
Figure 1:
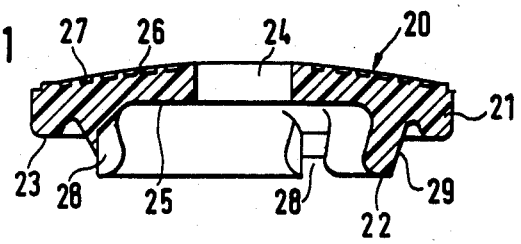
FIG. 1 is an enlarged axial sectional view of a centrally apertured annular female component which can be applied to a textile or other carrier in a machine embodying the present invention.
Figure 4:
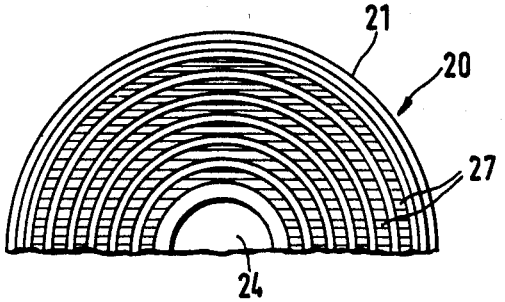
FIG. 4 is a fragmentary top plan view of the female component which is shown in FIGS. 1 and 2.
Figure 3:
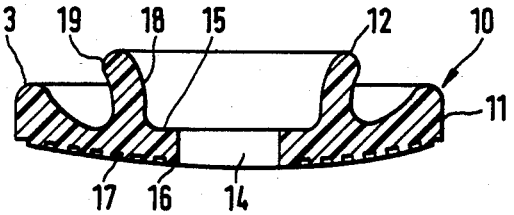
FIG. 3 is an enlarged axial sectional view of a centrally apertured annular male component which can be applied to a textile or other carrier in a machine embodying the present invention.
Figure 7:
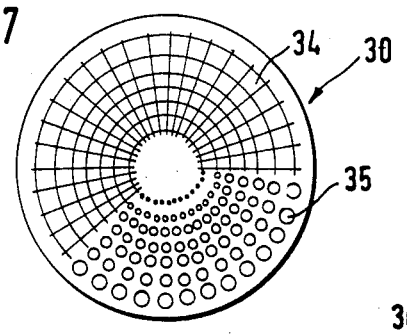
FIG. 7 is a bottom plan view of the connector which is shown in FIG. 5.
Figure 8:
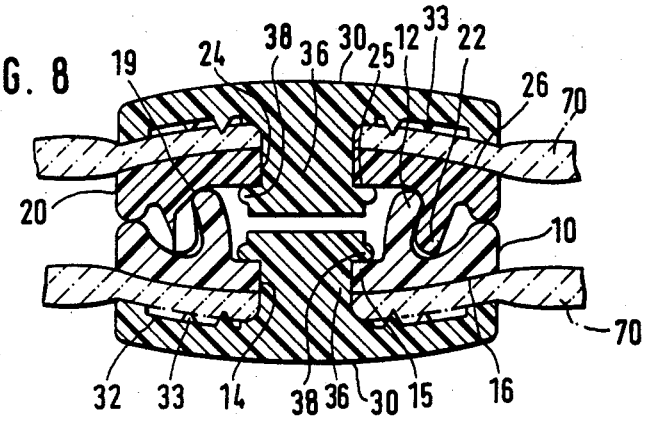
FIG. 8 is an enlarged axial sectional view of a fully assembled fastener including a female component, a male component, a first connector which secures the female component to a selected portion of a penetrable carrier and a second connector which secures the male component to another selected portion of the same penetrable carrier or to a portion of a second penetrable carrier.

FIGS. 1 and 2 show the female component 20 of a composite fastener of the type shown in FIG. 8. The female component 20 is an annular body made of a synthetic plastic material and having a round outer marginal portion 21 and a centrally located circular aperture 24. The concave inner side 25 of the component 20 has an annular female coupling element 22 consisting of three identical arcuate sections (see FIG. 2) which are partially separated from each other by radially extending slots 28. The outer marginal portion 21 has a ring-shaped circumferential bead 23 which spacedly surrounds the female coupling element 22. The convex outer side 26 of the female component 20 is formed with relatively shallow concentric grooves 27. That portion of the inner side 25 which immediately surrounds the respective end of the aperture 24 is flat or substantially flat and is overlapped by the deformed portion of the shank 36 of the corresponding connector 30 (shown in FIGS. 5 to 7) when the parts 20 and 30 are properly secured to each other so as to constitute one-half of a complete fastener.

The annular male component 10 of the fastener is also made of a synthetic plastic material; it has the same outer diameter as the female component 20 and it is also provided with a central aperture 14 whose diameter matches or closely approximates the diameter of the aperture 24 in the female component. The outer marginal portion 11 of the male component 10 has a circumferentially complete bead 13 and its convex outer side 16 is formed with concentric grooves 17. The male coupling element 12 of the component 10 is a circumferentially complete annulus which is spacedly surrounded by the bead 13, which spacedly surrounds the aperture 14 and which extends from the concave inner side 15 of the male component 10. The male coupling element 12 has a convex inner flank 18 which diverges in a direction away from the inner side 15, and the maximum-diameter part of the coupling element 12 is formed with a rounded engaging portion 19 which penetrates into the female coupling element 22 of the associated female component 20 when the components 10 and 20 are assembled into a fastener in a manner as shown in FIG. 8.

The multi-section female coupling element 22 of the component 20 yields when it is engaged by the rounded portion 19 on the male coupling element 12 of the corresponding male component 10. The sections of the female coupling element 22 thereupon move back nearer to each other to engage the concave outer flank of the male coupling element 12 and to thus hold the components 10 and 20 against accidental separation from one another. As can be seen in FIG. 1, the surfaces bounding the bottom zones of the radial slots 28 between the arcuate sections of the female coupling element 22 are stepped. The depth of the radially outermost portions of the slots 28 equals or approximates half the axial length of the female coupling element 22, and the radially innermost portions of such slots extend all the way or close to the inner side 25 of the female component 20. In contrast to the male coupling element 12 (whose outer flank is an outwardly curving frustoconical surface), the outer side or flank 29 of the female coupling element 22 is a true or substantially true frustoconical surface whose diameter diminishes at a constant rate in a direction away from the concave inner side 25.

Figure 5:
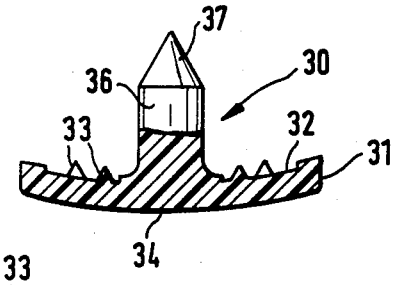
FIG. 5 is an enlarged partly axial sectional and partly elevational view of a rivet-shaped connector which can be used to secure male or female components of fasteners to textile or other carriers in a machine which embodies the present invention.
Figure 6:
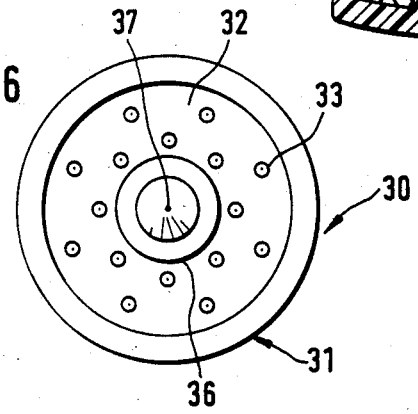
FIG. 6 is a top plan view of the connector which is shown in FIG. 5.

The connector 30 of FIGS. 5 to 7 resembles an undeformed rivet and has a cap-shaped rivet head 31 with a concave inner side 32 and a convex outer side 34. The centrally located shank or stem 36 extends from the concave side 32 and has a pointed (preferably conical) tip 37. The connector 30 is made of a synthetic plastic material which is ductile so that the tip 37 of the shank 36 can be permanently deformed into engagement with the concave inner side 15 of a male component 10 or with the concave inner side 25 of a female component 20. The concave side 32 of the head 31 has a plurality of preferably regularly distributed projections 33 in the form of pointed studs which penetrate into the material of a textile or other suitable carrier 70 (see FIGS. 8 and 10–13) to hold the connector 30 against angular movement relative to the carrier. The exposed convex side 34 of the head 31 has a relief 35 consisting of rounded lumps or protuberances which can be arrayed in a manner as shown in FIG. 7, i.e., they can form rows extending radially of the head 31 and the diameter of each protuberance which is nearer to the periphery of the head 31 is greater than the diameter of the neighboring protuberance. It can be said that the protuberances of the refief 35 which is shown in FIG. 7 form a plurality of circles, that the diameters of protuberances in each circle are the same, and that the diameters of protuberances in each larger-diameter circle exceed those of protuberances in the immediately adjacent smaller-diameter circle.

A fully assembled fastener is shown in FIG. 8. This fastener comprises a male component 10, a female component 20, a first or lower connector 30 which is secured to the male component 10, and a second or upper connector 30 which is secured to the female component 20. The shank 36 of the lower connector 30 extends through the central aperture 14 of the male component 10 and is deformed radially outwardly, as at 38 (i.e., its pointed tip 37 has been converted into a short cylinder with a circumferential bead 38), so that it overlies the concave inner side 15 in the region immediately around the aperture 14. The projections 33 have penetrated in part into the material of a textile sheet- or web-like carrier 70 which can constitute a portion of a garment and is clamped between the concave inner side 32 of the head 31 of the lower connector 30 and the convex outer side 16 of the male component 10. The upper connector 30 of FIG. 8 is deformed in the same way as the lower connector, i.e., a portion of its shank 36 is converted into a bead 38 which overlies the concave inner side 25 of the female component 20 immediately adjacent to the central aperture 24. The projections 33 of the upper connector 30 penetrate in part into a second carrier 70 which is clamped between the upper connector 30 and the convex outer side 26 of the female component 20. The second carrier 70 can form part of the garment which includes the first (lower) carrier 70 of FIG. 8. The circumferentially complete male coupling element 12 of the male component 10 is received and held between the arcuate sections of the female coupling element 22. The sections of the female coupling element 22 yield by being flexed radially outwardly when the two carriers 70 are pulled apart with a force sufficing to overcome the resistance which the sections of the female coupling element 22 offer to deformation by the rounded portion 19 of the male coupling element 12.

Figure 20:
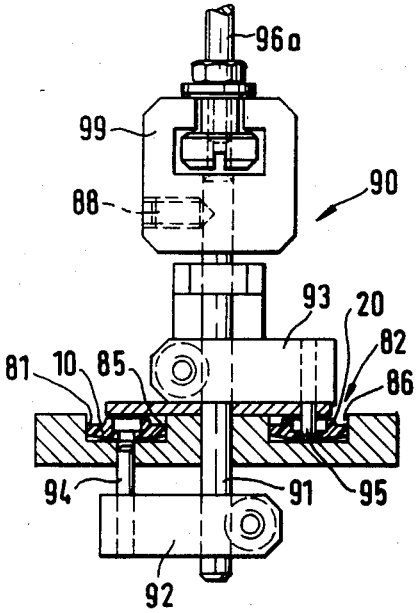
FIG. 20 is a sectional view as seen in the direction of arrows from the line XX—XX of FIG. 19 and shows the means for blocking the admission of male or female components into the receiving means.
Figure 21:
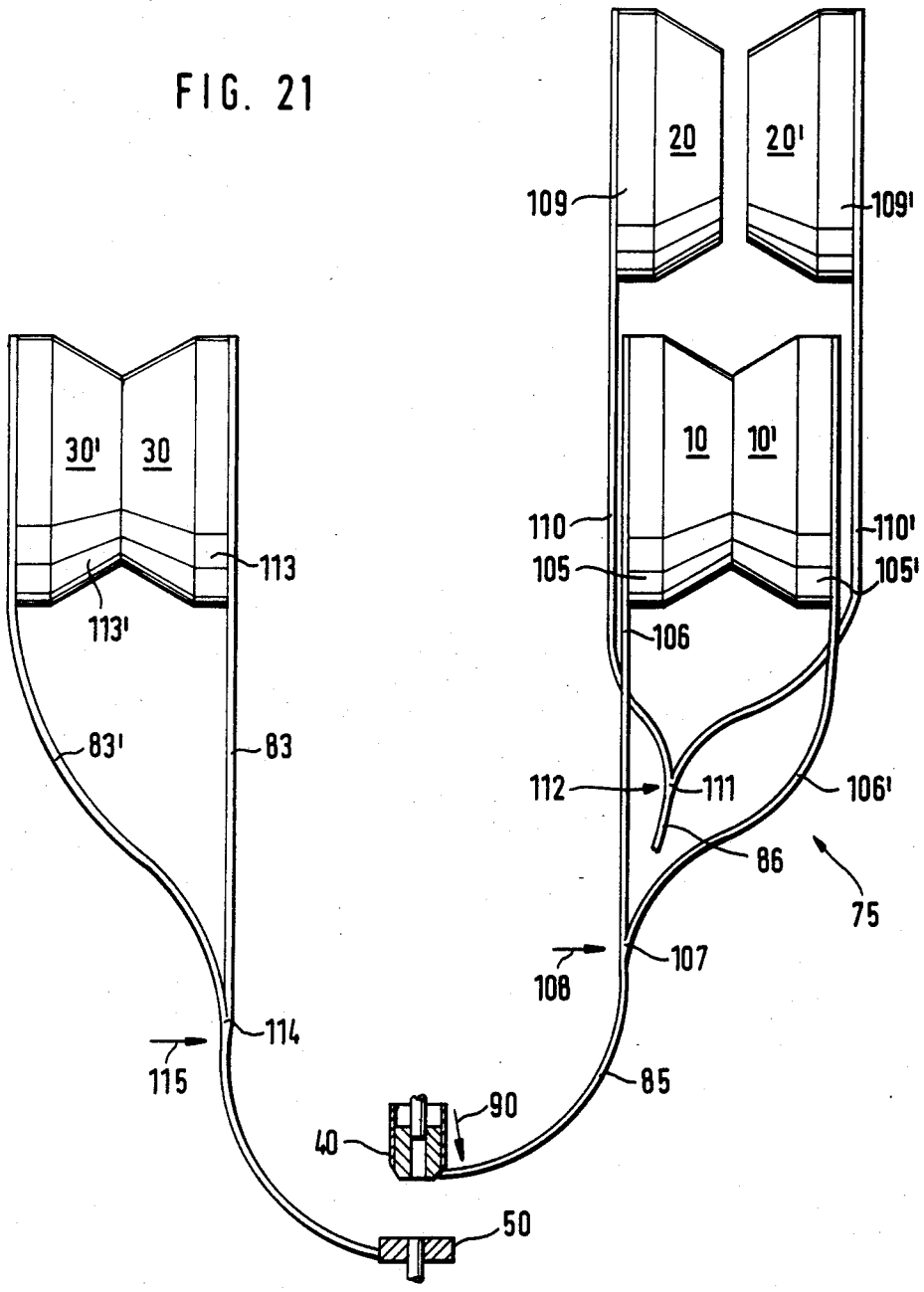
FIG. 21 is a fragmentary schematic partly elevational and partly sectional view of a modified machine with several sources of male and female components, with several sources of connectors and with means for selecting the connectors and the male or female components which are to be fed to the respective tools.

The source of connectors 30 is a magazine (see the magazine 113 of FIG. 21), and the components 10 and 20 are supplied by two additional discrete sources (such as the magazines 105 and 109 of FIG. 21). Feeding units 81, 82 (FIGS. 14–16 and 19–21) for the male components 10 and female components 20 are provided to supply the respective components from the corresponding magazines into the channel of a trough-shaped device 84 constituting a means for receiving discrete components 10 or 20 from the feeding unit 81 or 82. The trough-shaped receiving device 84 forms part of an inserting unit 80 whose function is to supply the corresponding tool (40) of the improved machine with male or female components 10 or 20. The channel of the trough-shaped receiving device 84 is elongated and its width is such that it can receive a single male component 10 from the feeding unit 81 or a single female component 20 from the feeding unit 82. The thus introduced or admitted component 10 or 20 is located in the path of reciprocatory movement of a pusher 87 which constitutes a means for delivering male components 10 or female components 20 into the chamber or space 65 between the jaws 42 of a gripper or tongs 41 forming one of three main constituents of the respective (upper or second) tool 40 of the improved machine. The feeding units 81 and 82 comprise elongated rails 85, 86 which define for the respective (male and female) components 10, 20 elongated partially arcuate and partially straight paths (see FIG. 21) along which the components advance toward and into the channel of the receiving device 84. The rails 85 and 86 are designed to deliver the respective components 10 and 20 in a predetermined orientation, namely so that the corresponding coupling elements 12 and 22 face toward the observer of FIGS. 14 to 16. The rails 85 and 86 define suitable channels or chutes (see particularly FIG. 20) wherein a single row of the respective components descends or slides (preferably by gravity) toward the channel of the receiving device 84. The manner in which the components 10 and 20 are transferred from the respective sources or magazines 105, 109 into the channels of the rails 85 and 86 may be the same or similar to the manner of delivering bottle caps from a magazine which contains randomly distributed and oriented caps into a singularizing device which delivers a series of caps in predetermined orientation to the bottle capping station in a brewery, dairy or another bottling plant.

Figure 19:
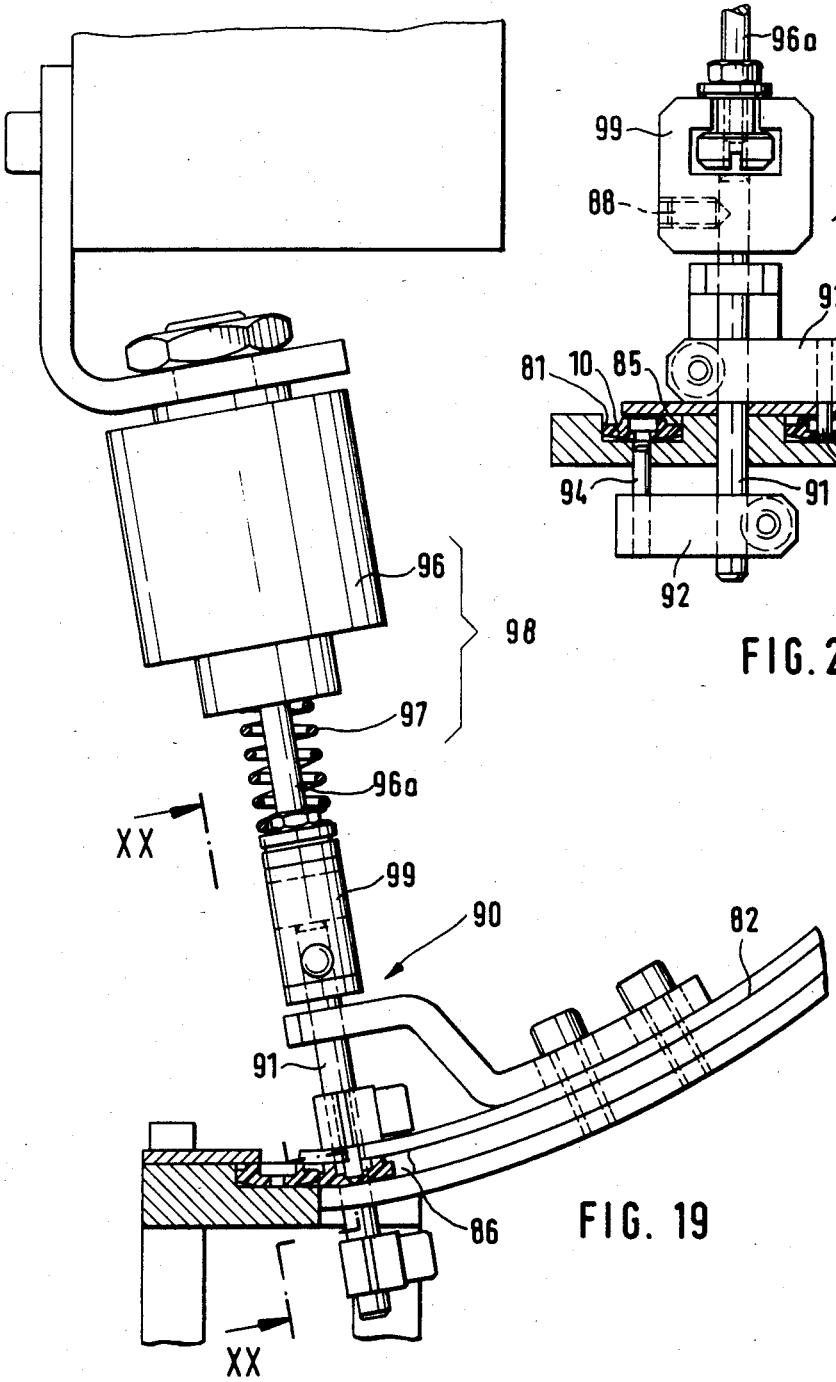
FIG. 19 is a sectional view as seen in the direction of arrows from the line XIX—XIX of FIG. 14, showing the means for inactivating the device for feeding male or female components into the receiving means of FIGS. 14 to 16.

As can be seen in FIGS. 19 and 20, the machine comprises an inactivating device or barrier 90 which is installed in the region where the channels defined by the rails 85 and 86 of the feeding units 81, 82 for the male and female components 10, 20 discharge into the channel of the receiving device 84. The purpose of the barrier 90 is to prevent the admission of male components 10 into the channel of the receiving device 84 when such channel receives female components 20 and vice versa. The barrier 90 comprises a reciprocable plunger 91 which supports two axially adjustable radially extending supporting arms 92, 93 respectively supporting blocking pins 94 and 95. The arms 92, 93 extend in opposite directions from the respective portions of the plunger 91, and the blocking pins 94, 95 extend in opposite directions as considered axially of the plunger 91. The exposed portions of the blocking pins 94 and 95 are reciprocable in suitable holes or bores which are provided therefor in the corresponding rails 85 and 86. Such blocking pins extend at right angles to the paths of movement of the respective male and female components 10 and 20 in the channels of the respective rails 85 and 86.

The plunger 91 is movable between two end positions by an activating or control unit 98 including an electromagnet 96 and a restoring coil spring 97. The armature of the electromagnet 96 can include or constitute the plunger 91; however, in the embodiment which is shown in FIGS. 19 and 20 the armature 96*a* of the electromagnet 96 is adjustably connected to the plunger 91 by a retainer 99 which is separably affixed to the armature 96*a* in a manner as shown in the upper portion of FIG. 20 and which is separably connected with the adjacent end portion of the plunger 91 by a screw 88. The coil spring 97 surrounds the exposed portion of the armature 96*a* and reacts against the housing of the electromagnet 96 to urge the retainer 99 and hence the plunger 91 downwardly, as viewed in FIG. 19, to one of the two end positions. The plunger 91 assumes the other end position in response to energization of the electromagnet 96, i.e., when the armature 96*a* moves the retainer 99 upwardly and causes the coil spring 97 to store energy. The activating or control unit 98 including the electromagnet 96 and the restoring spring 97 determines whether the channel of the receiving device 84 is supplied with male components 10 or with female components 20.

Figure 14:
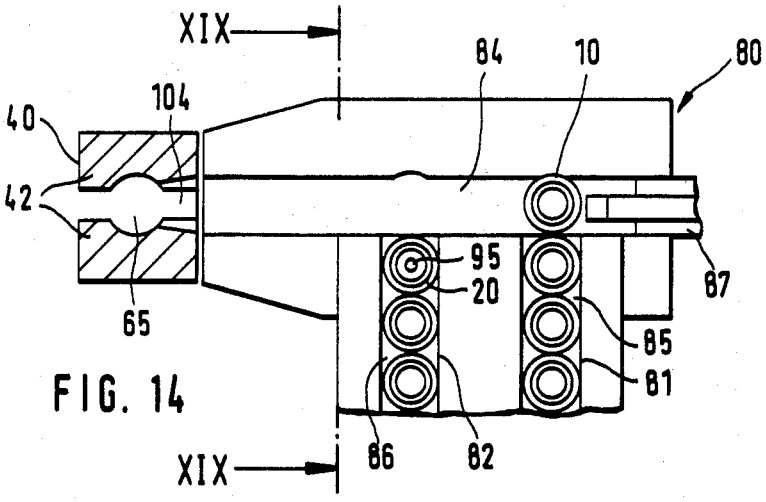
FIG. 14 is a fragmentary plan view of the means for receiving male or female components from the respective feeding means and further showing a portion of the means for delivering discrete male or female components to the gripper means of the upper tool, a male component being located in the receiving means in the path of movement of delivering means toward the gripper means.

If the receiving device 84 is to be supplied with one or more male components 10, the activating control unit 98 ensures that the electromagnet 96 is deenergized, i.e., the spring 97 can dissipate energy and moves the plunger 91 downwardly, as viewed in FIGS. 19 and 20, to the end position of FIG. 20 in which the blocking pin 95 extends into the channel of the rail 86 but the blocking pin 94 is located at a level below the channel of the rail 85. The diameter of the blocking pin 95 is such that this pin can spear the nearest female component 20 by penetrating into it central aperture 24. This is shown in FIG. 14 which further shows that the foremost male component 10 has entered the channel of the receiving device 84 and is located in front of the delivering member 87 which is held in the fully retracted position at a maximum distance from the jaws 42 of the gripper or tongs 41 of the corresponding tool 40. As mentioned above, the male and female components 10 and 20 advance in the channels of the respective rails 85 and 86 by gravity, i.e., the slope of such channels suffices to ensure predictable advancement of components 10 and 20 toward the channel of the receiving device 84.

If the receiving device 84 is to be supplied with one or more female components 20, the activating or control unit 98 energizes the electromagnet 96 which retracts the armature 96*a* and plunger 91 against the opposition of the restoring spring 97 whereby the blocking pin 95 is extracted from the channel of the rail 86 to release the row of female components 20 for gravitational advancement toward the receiving device 84. At the same time, the blocking pin 94 moves upwardly, as viewed in FIG. 20, and spears the nearest male component 10 by entering its centrally located aperture 14. This can be seen in FIG. 15. The row of female components 20 in the channel of the rail 86 is then free to advance by gravity and in stepwise fashion so that the foremost or lowermost female component 20 of such row enters the channel of the receiving device 84 whenever the delivering member 87 assumes the retracted position of FIG. 15. The member 87 then performs a forward stroke to assume its extended position 87′ (see FIG. 16) with the result that the female component 20 which has entered the channel of the receiving device 84 is transferred into the chamber or space 65 between the jaws 42 of the gripper or tongs 41. The transfer of a female component 20 into the chamber 65 takes place in a predetermined position of the respective tool 40. The means for reciprocating the delivering member 87 in synchronism with movements of certain parts of the tool 40 can comprise a set of cams (not specifically shown) mounted on a camshaft which is driven at a constant or at a variable speed. Reference may be had to the aforementioned commonly owned copending patent application Ser. No. 599,176 of Ernst Herten which describes and shows a system of cams for reciprocating certain parts of the upper tool of a pair of confronting tools in a riveting press and for imparting synchronous movements to certain other constituents of the press. The member 87 is returned to the retracted position of FIG. 14 or 15 as soon as it completes the delivery of a male or female component into the chamber 65 between the jaws 42 of the gripper 41. This enables the foremost male component 10 or the foremost female component 20 of the rows of such components in the channels of the respective rails 85, 86 to enter the channel of the receiving device 84 so that the admitted male or female component is ready for transfer into the chamber 65.

The positions of the blocking pins 94 and 95 with reference to the paths of male and female components 10, 20 in the channels of the respective rails 85 and 86 can be adjusted by loosening the screw 88 and shifting the plunger 91 axially to a position at a greater or lesser distance from the armature 96*a* of the electromagnet 96.

The dimensions of the outer marginal portions 11 and 21 of the male and female components 10, 20 are the same or substantially identical so that the jaws 42 of the gripper 41 can properly hold a male component 10 or a female component 20. Also, the diameters of the central apertures 14 and 24 in the components 10 and 20 are the same or practically identical so that one and the same type of connectors 30 can be used for attachment to the components 10 and 20. Moreover, this renders it possible to simplify the construction of the inactivating means 90 because the diameter of the blocking pin 94 can match that of the blocking pin 95. These blocking pins automatically find their way into the central apertures 14 and 24 of the nearest male and female components 10 and 20 in the channels of the respective rails 85 and 86 because the nearest component 10 or 20 is located at a predetermined distance from the channel of the receiving device 84. The axial length of the male coupling elements 12 preferably matches or closely approximates the axial length of the female coupling elements 22; this ensures that the male components 10 can slide in the channel of the receiving device 84 with the same facility as the female components 20 and also that the dimensions of the channel in the rail 85 can match or closely approximate those of the channel in the rail 86.

The inserting unit 78 which serves to introduce discrete connectors 30 into the socket 53 of the other (first or lower) tool 50 of the improved machine is shown in FIGS. 17 and 18. This unit is analogous to the inserting unit 80 of FIGS. 14 to 16 and 19–20 except that the channel of its trough-shaped receiving device 89 communicates with the discharge end of a single connector-supplying channel, namely the channel which is defined by the rail of the feeding unit 83 which accepts a row of properly oriented connectors 30 from the corresponding source or magazine 113. The channel which is defined by the rail of the feeding unit 83 slopes downwardly, i.e., the magazine 113 is located at a level sufficiently above the level of the tool 50 to ensure that the connectors 30 can advance toward and into the channel of the receiving device 89 by gravity feed. The orientation of each connector 30 which enters the channel of the receiving device 89 is such that its shank 36 extends upwardly (this can be readily seen in FIGS. 17 and 18 as well as in FIGS. 9 to 11). The connector 30 which enters the channel of the receiving device 89 is located in front of the suitably configurated leader 101 of a reciprocable pusher 100 which constitutes a means for introducing successive connectors 30 into the socket 53 of the tool 50. As can be seen in FIG. 17, the leader 101 of the pusher 100 has a notch which receives a portion of the shank 36 of the connector in the receiving device 89 to safely and predictably guide the connector on its way into the socket 53. The means for reciprocating the pusher 100 in the channel of the receiving device 89 is not specifically shown; such reciprocating means can be analogous to the aforediscussed reciprocating means for the pusher 87 and can receive motion from the same camshaft in synchronism with movements of parts of the tools 40 and 50 relative to each other. The extended position of the pusher 100 is shown in FIG. 18, as at 100'.

Figure 9:
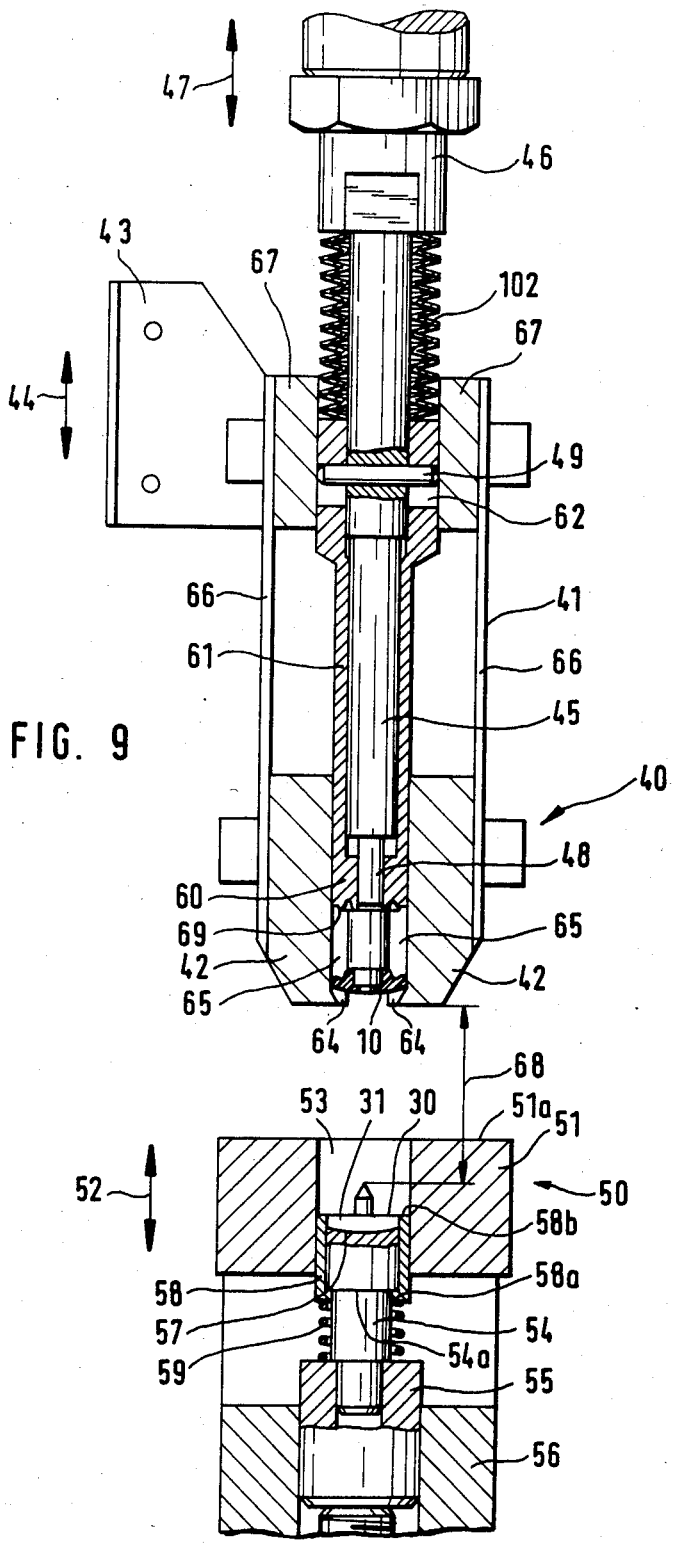
FIG. 9 is a fragmentary axial sectional view of the tools in a machine which embodies one form of the invention, the upper tool being shown in the retracted position, a male component being held by the gripper means of the upper tool and a connector being received in the socket of the lower tool.

FIG. 9 shows certain parts of the improved machine, and more particularly the construction of the two confronting tools including the first or lower tool 50 which defines the socket 53 for reception of connectors 30 from the channel of the receiving device 89 and the second or upper tool 40 which includes the aforementioned gripper or tongs 41 with jaws 42 bounding the chamber 65 for male or female components 10 or 20 which are supplied by the receiving device 84 and pusher 87.

The gripper 41 of the tool 40 is mounted on a holder 43 which is reciprocable in directions indicated by a double-headed arrow 44. The jaws 42 of the gripper 41 are movable toward and away from each other (substantially at right angles to the directions indicated by the arrow 44) and, to this end, are mounted at the lower ends of leaf springs 66 whose upper ends are affixed to the holder 43. The jaws 42 surround a vertically reciprocable deforming member 45 which includes a smaller-diameter lower end portion or working end 48 serving to deform the uppermost portion or tip 37 of the shank 36 forming part of the connector 30 which is received in the socket 53 of the lower tool 50 when the deforming member 45 performs a downward stroke. The directions of reciprocatory movement of the deforming member 45 and its working end 48 are indicated by the double-headed arrow 47. The upper end portion of the deforming member 45 is separably affixed to a holder 46 which, together with the holder 43, constitutes or forms part of the means for reciprocating the three main parts of the upper tool 40 relative to the lower tool 50. The phase and amplitude of reciprocatory movements of the deforming member 45 deviate from the phase and amplitude of the reciprocatory movements of the gripper 41.

The smaller-diameter working end 48 of the deforming member 45 is surrounded by a ring-shaped back support or hold-down device 60 having an annular lower end face 69 which is in contact with the male component 10 or female component 20 while the component is held in the chamber 65 between the jaws 42 of the gripper 41 and the working end 48 of the deforming member 45 is in the process of upsetting the tip 37 of a shank 36 after the shank 36 has penetrated through the material of a carrier 70 between the tools 40, 50 and has also penetrated through and partially upwardly and beyond the aperture 14 or 24 of the component 10 or 20.

Figure 11:
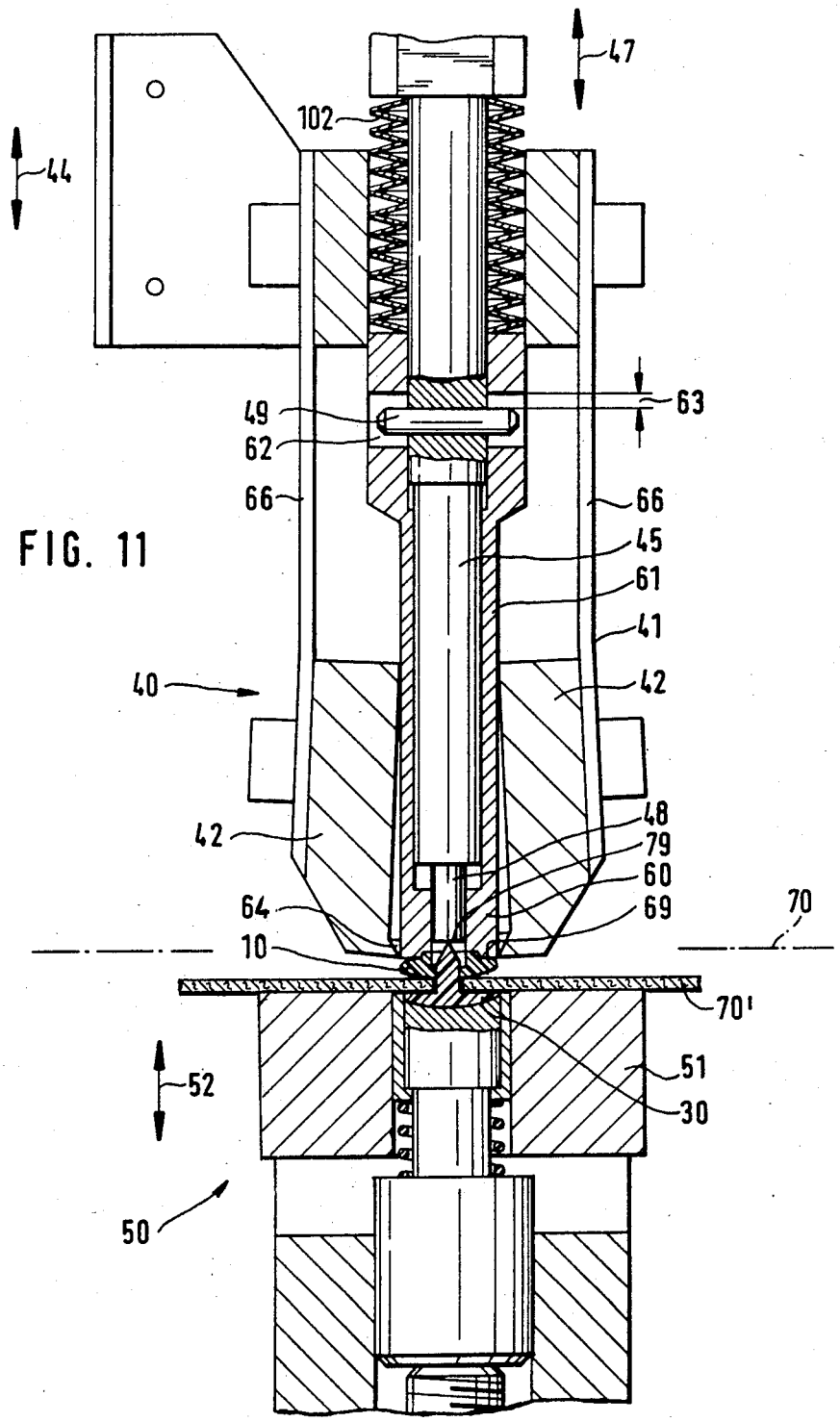
FIG. 11 illustrates the structure of FIG. 10 but with the upper tool in a second intermediate position in which the shank of the connector has penetrated through the carrier and into the centrally located aperture of the male component which is held by the gripper means of the upper tool.

The back support 60 constitutes an important third part of the upper tool 40 and includes an upwardly extending sleeve-like extension 61 which surrounds the larger-diameter main portion of the deforming member 45 and whose enlarged upper end portion or boss has an elongated slot 62 for a diametrically extending pin 49 in the deforming member 45. The surfaces bounding the slot 62 and the pin 49 constitute a means for limiting the extent of movability of the deforming member 45 and back support 60 relative to each other. The maximum extent of such movability is shown at 63 in FIG. 11. The boss at the upper end of the extension 61 abuts against the lowermost dished spring of a package 102 of dished springs which surround the upper portion of the deforming member 45 and whose uppermost spring bears against the underside of the holder 46 for the member 45. The package 102 of dished springs tends to maintain the back support 60 in the lower end position (FIG. 9) with reference to the deforming member 45, i.e., in a position in which the end portions of the transverse pin 49 are received in the uppermost parts of the respective portions of the slot 62 in the extension 61 of the back support 60. The package 102 can yield to a predetermined force which urges the back support 60 upwardly with reference to the deforming member 45 so that the back support 60 then assumes the upper end position or an intermediate position which latter is shown in FIG. 11. The back support 60 participates in the majority of movements of the deforming member 45 in directions which are indicated by the arrow 47.

The reference characters 67 denote mounting blocks which are carried by or from part of the holder 43 and support the upper end portions of leaf springs 66 for the jaws 42 of the gripper 41.

Figure 15:
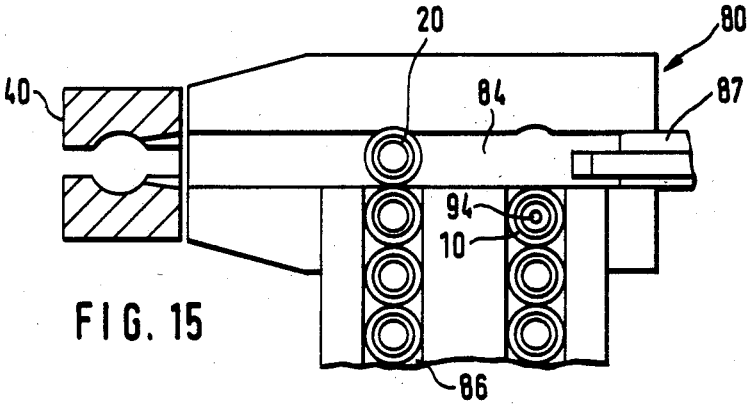
FIG. 15 illustrates the structure of FIG. 14 but with a female component located in the receiving means in front of the retracted delivering means.
Figure 16:
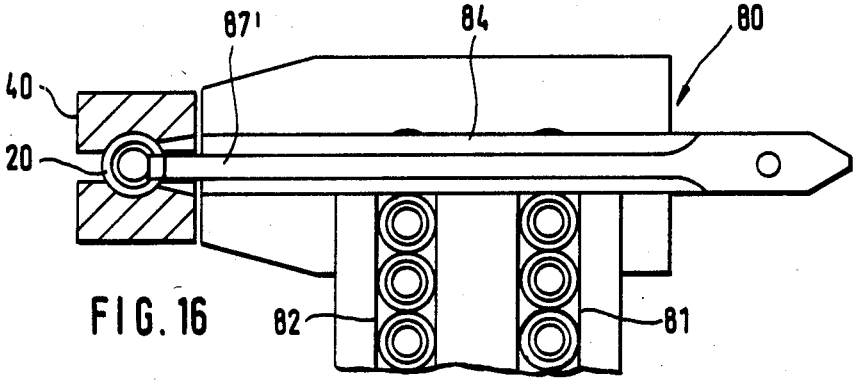
FIG. 16 illustrates the structure of FIG. 15, with the delivering means in extended position it assumes at the instant of insertion of the female component between the jaws of the gripper means.

The discharge end of the channel which is defined by the receiving device 84 of FIGS. 14 to 16 is adjacent to the chamber 65 between the jaws 42 of the gripper 41. The chamber 65 is a substantially cylindrical space which is located at a level above conical inner sides or faces 64 of the jaws 42. The surfaces bounding the chamber or space 65 guide the external surface of the back support 60 when the jaws 42 are free to assume the positions of FIG. 9, i.e., at a minimum distance from one another.

FIG. 9 shows the tool 40 in its upper end position in which the lower end faces of the jaws 42 are spaced apart from the horizontal upper surface **51*a* of a platform 51 forming part of the lower tool 50 and surrounding the socket 53 so that a carrier 70 can be inserted into the space between the tools 40, 50 in such a way that the carrier overlies the surface 51*a* of the platform 51 and the connector 30 in the socket 53. The tool 40 is ready to receive a male component 10 or a female component 20 between the jaws 42 of its gripper 41 when it dwells in the upper end position of FIG. 9. The pusher 87 then moves to the extended position 87' of FIG. 16 and delivers a male component 10 or a female component 20 into the chamber 65 by way of an inlet 104 (FIG. 14) whose width increases during introduction of the component 10 or 20, i.e., the leaf springs 66 are flexed to allow the jaws 42 to move away from each other and to thus permit introduction of the component 10 or 20 into the chamber 65 at a level above the conical faces 64. A properly inserted male component 10 is shown in FIG. 9 directly above the conical faces 64 of the jaws 42 in the lowermost portion of the chamber 65. At such time, the lower end face 69 of the back support 60 is spaced apart from the upper (concave) side 15 of the male component 10 in the chamber 65**.

In addition to the platform 51, the tool 50 comprises a cylindrical ram 54 which has a concave top surface 57 for the convex outer side 34 of the head 31 of the connector 30 in the socket 53. The platform 51 is biased upwardly by one or more springs, not shown, in a manner as disclosed in the aforementioned copending patent application Ser. No. 599,176 of Ernst Herten so that it normally assumes the upper end position which is shown in FIG. 9. The platform 51 then abuts against a suitable stop (not shown) in the frame 56 of the improved machine. The directions of movement of the platform 51 under and against the opposition of the just mentioned spring or springs (e.g., a set of two or more coil springs) are indicated by a double-headed arrow 52. The platform 51 descends, to cause the corresponding spring or springs to store energy, under the action of the upper tool 40 when the latter descends and shifts the platform below the upper end position of FIG. 9 through the medium of a carrier 70 resting on the supporting surface 51*a*.

The platform 51 has a lateral inlet 103 (see FIGS. 17 and 18) which establishes communication between the socket 53 and the channel of the receiving device 89 so that a connector 30 which has entered the device 84 from the discharge end of the channel in the rail of the feeding unit 83 can enter the socket 53 when the introducing means or pusher 100 of the inserting unit 78 moves to the extended position 100' of FIG. 18.

The cylindrical ram 54 of the tool 50 is mounted on a stationary support 55 which is removably installed in the frame 56 of the machine so that the ram 54 can be replaced with a different ram if the machine is to employ connectors that deviate substantially from the illustrated connectors 30. The ram 54 has a smallest-diameter lower end portion which is a press fit in or is otherwise fixedly installed in the support 55, a larger-diameter median portion which is surrounded by a coil spring 59 reacting against the support 55, and a maximum diameter upper end portion which is formed with the concave supporting surface 57 for the convex side 34 of the head 31 of the connector 30 in the socket 53. The maximum-diameter portion of the ram 54 is surrounded by a tubular confining member 58 in the form of a sleeve which is reciprocable relative to the ram 54 under the action or against the opposition of the coil spring 58 and has a lower end portion in the form of an annular inwardly extending collar 58*a* cooperating with a shoulder 54*a* between the maximum-diameter upper end portion and the intermediate portion of the ram 54 to thus determine the upper end position of the confining member 58. In such upper end position, the uppermost part of the confining member 58 extends upwardly beyond the concave upper surface 57 of the ram 54 and surrounds the outer marginal portion of the head 31 in the socket 53 of the tool 50.

The discharge end of the channel which is defined by the receiving device 89 of FIGS. 17 and 18 extends at right angles to the plane of FIG. 9 and registers with the inlet 103 leading to the socket 53 when the platform 51 is allowed to assume the upper end position of FIG. 9. The freshly inserted connector 30 descends onto the concave surface 57 of the ram 54 and its outer marginal portion is surrounded by the upper end portion of the tubular confining member 58 because the latter then assumes the upper end position of FIG. 9 in which the collar 58*a* abuts against the shoulder 54*a* under the action of the coil spring 59. The upper end face 58*b* of the confining member 58 is then at least substantially flush with the radially outermost portion of the concave inner side 32 of the head 31 in the socket 53. The confining member 58 cooperates with the ram 54 to properly center the connector 30 in the socket 53 of the lower tool 50.

The carrier 70 (see FIG. 10) can be inserted between the tools 40 and 50 by hand so that it overlies the surface 51*a* of the platform 51 and that a selected (preferably marked) portion of the carrier overlies the connector 30 in the socket 53. As mentioned above, the carrier 70 can constitute a panel of a garment which is made of a textile or snythetic plastic material. The marking on the carrier 70 can be in the form of a circle which is to register with the socket 53 before the upper tool 40 begins to descend toward the first intermediate position of FIG. 10. The tool 40 can begin to perform a downward stroke in automatic response to detection of proper positioning of the carrier 70 on the surface 51*a* of the platform 51 or in response to depression of a pedal or another suitable starting element (not shown) which is depressed or otherwise displaced by the person manipulating the carrier 70.

Figure 10:
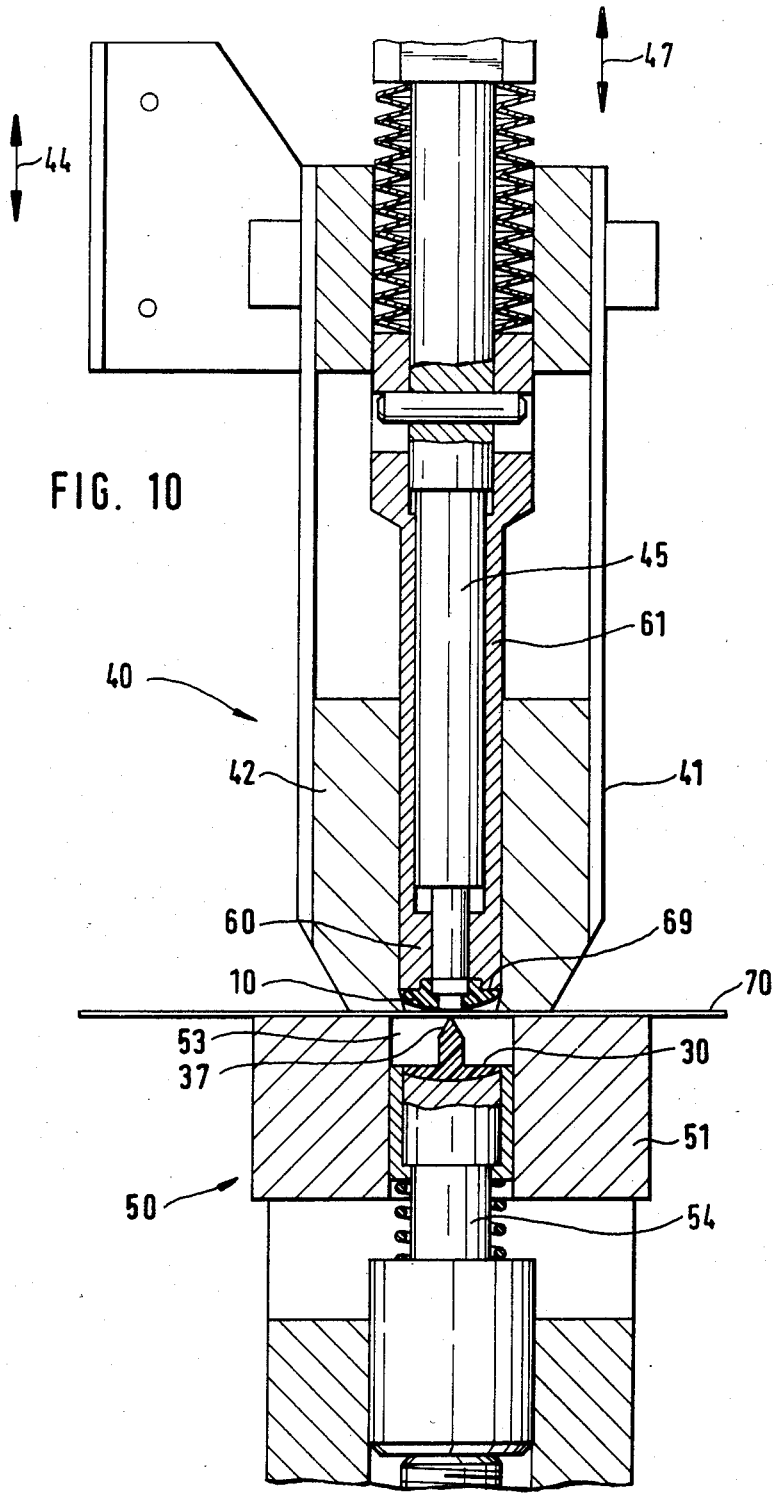
FIG. 10 is an enlarged view of a detail in the machine of FIG. 9, showing the upper tool in a first intermediate position and a portion of a penetrable carrier between the two tools.

In the intermediate position of the tool 40 which is shown in FIG. 10, the jaws 42 of the gripper 41 bear against the upper side of the carrier 70 at a level above the supporting surface 51*a* of the platform 51 and maintain the platform at a level below its upper end position. Thus, the platform 51 is shifted downwardly relative to the ram 54 (which is mounted on the fixed support 55) and relative to the tubular confining member 58 which is held in the upper end position (collar 58*a* abuts against the shoulder 54*a*) under the action of the coil spring 59. The platform 51 thereby stresses the aforementioned spring or springs which tend to maintain it in the upper end position of FIG. 9. In view of the descent of platform 51 to a level below its upper end position, the pointed tip 37 of the shank 36 of the connector 30 in the socket 53 is immediately adjacent to or in actual contact with the underside of that portion of the carrier 70 which overlies the socket 53 of the lower tool 50.

FIG. 10 further shows that the first stage of downward movement of the upper tool 40 from the upper end positicn of FIG. 9 involves a downward movement of the back support 60 relative to the gripper 41 so that the annular lower end face 69 of the back support catches up with and abuts against the male component 10 in the lowermost part of the chamber 65.

Figure 12:
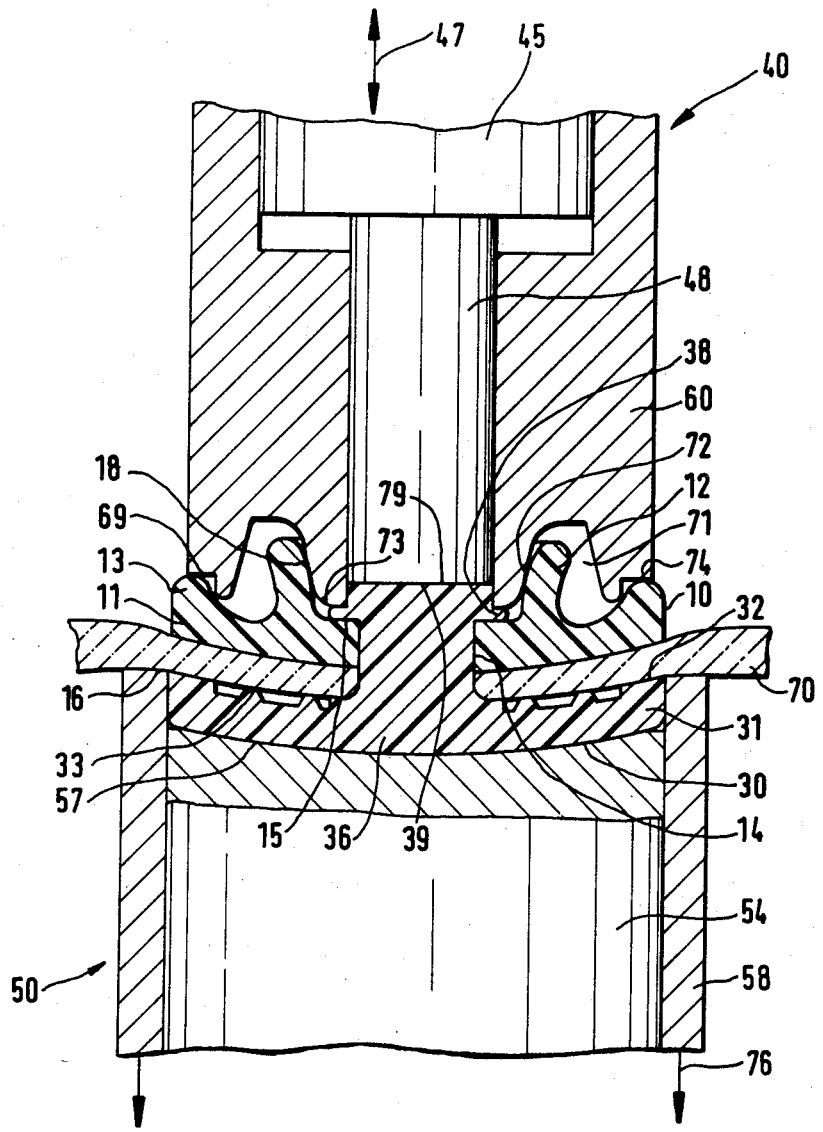
FIG. 12 is an enlarged view of a detail in the structure of FIG. 11, showing the upper tool in the extended position and with a portion of the shank of the connector upset so that it overlies the adjacent portion of the upper side of the male component.

The manner in which the end face 69 engages the male component 10 between the jaws 42 of the gripper 41 is shown on a larger scale in FIG. 12. Thus, the male coupling element 12 of the component 10 extends into an annular groove 71 which is machined into the lower end face 69 and spacedly surrounds the bore for the working end 48 of the deforming member 45. The groove 71 is flanked by an inner annular surface 72 which is in contact with the convex inncr flank 18 of the male coupling element 12 not later than when the tool 40 assumes the intermediate position of FIG. 10 whereby the annular surface 72 centers the coupling element 12 and hence the entire male component 10 in the chamber 65 of the gripper 41. This ensures that the shank 36 of the connector 30 in the socket 53 of the lower tool 50 can find its way into the central aperture 14 of the male component 10. The annular radially innermost portion 73 of the back support 60 in the region of the lower end face 69 is then surrounded by the male coupling element 12 of the component 10 and extends downwardly and slightly beyond the end face 79 of the working end 48 of the deforming member 45 when the tool 40 reaches the lower end position of FIG. 12. The annular portion 73 is surrounded by the coupling element 12 and thereby prevents deformation of such coupling element in a direction toward the axis of the working end 48.

The end force 69 of the ring-shaped back support 60 is further formed with an annular recess 74 which is adjacent to the periphery of the back support 60 and receives the bead 13 of the outer marginal portion 11 of the male component 10 in the chamber 65. This also contributes to the centering action of the back support 60.

The jaws 42 of the gripper 41 cooperate with the platform 51 to stretch the material of the carrier 70 which rests on the supporting surface 51*a* of the platform 51 and to thus facilitate penetration of the pointed tip 37 of the shank 36 of the connector 30 in the socket 53 through the carrier 70 when the upper tool 40 descends from the first intermediate position of FIG. 10 to the second intermediate position of FIG. 11. The convex side 16 of the male component 10 is then adjacent to or is in actual contact with the upper side of the carrier 70 and the shank 36 has entered the central aperture 14 of the male component 10 which is then located at a level below the jaws 42 of the gripper 41. The penetration of the tip 37 of the shank 36 through the carrier 70 is completed when the tool 40 reaches the second intermediate position of FIG. 11. The jaws 42 and the male component 10 have lowered the platform 51 so that the carrier 70 has descended from the phantom-line position to the solid-line position 70' in which it continues to overlie the supporting surface 51*a* of the platform 51 and is already pierced by the shank 36 of the connector 30 in the socket 53. FIG. 11 shows the gripper 41 of the upper tool 40 in the lower end position but the deforming member 45 still has a certain freedom of downward movement relative to the jaws 42 (to the lower end position of FIG. 12) in order to deform the tip 37 of the shank 36 so that the tip 37 is converted into the cylinder which was described in connection with FIG. 8 and has an annular bead 38 overlying the adjacent portion of the concave side 15 of the male component 10 immediately adjacent to the central aperture 14.

Expulsion of the male component 10 from the chamber 65 of the gripper 41 has taken place during movement of the tool 40 from the first intermediate position of FIG. 10 to the second intermediate position of FIG. 11. More specifically, such expulsion of the male component 10 took place due to the fact that the extent of downward movement of the back support 60 is greater than the extent of downward movement of the gripper 41 so that the lower end face 69 of the back support 60 slides in the chamber 65 and pushes the entire male component 10 along the conical faces 64 of the jaws 42 and out of the chamber 65. The jaws 42 can move apart against the opposition of the respective leaf springs 66 and thereupon again move nearer to each other as soon as the lower end portion of the back support 60 is again retracted into the normally cylindrical chamber 65 of the gripper 41. The provision of conical faces 64 at the inner sides of the jaws 42 facilitates the spreading action of the male component 10 which is being pushed downwardly by the ring-shaped back support 60 so that the jaws 42 move apart gradually at a rate which is determined by the inclination of their conical faces 64 and by the rate of downward movement of the back support 60 with reference to the gripper 41. When the back support 60 reaches the lower end position of FIG. 11, its cylindrical peripheral surface is engaged by the conical faces 64 of the jaws 42 so that such jaws are held apart as long as the back support continues to dwell in its lower end position. The movement of the back support 60 to the lower end position of FIG. 11 entails penetration of the shank 36 of the connector 30 in the socket 53 into and partially upwardly beyond the axial aperture 14 of the male component 10 so that the tip 37 of such shank is in an optimum position for axial and radial deformation by the lower end face 79 of the working end 48. In fact, and as shown in FIG. 11, the back support 60 can reach its lower end position at the exact moment when the lower end face 79 of the working end 48 of the deforming member 45 comes in contact with the tip 37 of the shank 36 at a level above the aperture 14 of the male component 10.

The extent of downward movement of the back support 60 relative to the deforming member 45 during movement of the upper tool 40 from the first intermediate position of FIG. 10 to the second intermediate position of FIG. 11 is shown in FIG. 11, as at 63. Such shifting of the deforming member 45 relative to the back support 60 takes place because the male component 10 at the lower end of the ring-shaped back support 60 encounters a resistance to downward movement by the stretched carrier 70 on the surface 51*a* of the platform 51 and/or by the connector 30 in the socket 53. This entails a certain deformation of the package 102 of dished springs which store energy while the deforming member 45 descends relative to the arrested or slower back support 60 through the aforementioned distance 63.

During the last stage of downward movement of the upper tool 40 (actually of the deforming member 45), namely from the position of FIG. 11 to the position of FIG. 12, the working end 48 acts upon and deforms the tip 37 of the shank 36 so that the shank is provided with the aforediscussed radially outwardly extending bulge or beard 38 which overlies the radially innermost portion of the inner side 15 of the male component 10 to thus ensure the establishment of a reliable mechanical connection between the parts 10 and 30 and to simultaneously ensure that the portion of the carrier 70 which has been pierced by the shank 36 is reliably clamped between the convex outer side 16 of the male component 10 and the concave inner side 32 of the head 31 of the connector 30. Moreover, the projections 33 of the connector 30 penetrate into the material of the carrier 70 and thus prevent angular movements of the connector 30 and male component 10. When the deforming action of the working end 48 upon the shank 36 is completed, the pin 49 of the deforming member 45 is located in or close to the lowermost portion of the slot 62 in the extension 61 of the back support 60.

During deformation of the shank 36 by the working end 48 of the deforming member 45, the bead 13 on the outer marginal portion 11 of the male component 10 rests in the annular recess 74 of the lower end face 69 of the back support 60 so that the male component 10 is held against radial movement relative to the back support while the working end 48 performs its deforming or upsetting action. The surface bounding the recess 74 further serves to urge the underside of the marginal portion 11 of the male component 10 against the radially outermost portion of the concave side 32 of the head 31 of the connector 30 in the socket 53 so that the convex outer side 34 of the head 31 is urged against the complementary concave surface 57 of the ram 54 below the socket 53.

As mentioned above, the inner annular surface 72 in the groove 71 is engaged by the rounded portion 19 of the male coupling element 12 to prevent deformation of the coupling element 12 radially inwardly toward the axis of the aperture 14. Thus, when the working end 48 of the deforming member 45 brings about a cold flow of the synthetic plastic material of the shank 36 so as to form the bead 38 which overlies the radially innermost portion of the inner side 15 of the male component 10, the latter is reliably held in an optimum position with reference to the connector 30 in the socket 53 and its male coupling element 12 is reliably held against deformation such as would prevent it from adequately engaging the female coupling element 22 of a female component 20 in a manner as shown in FIG. 8. The descending working end 48 of the deforming member 45 expels plastic material of the shank 36 from the space within thc confines of the annular portion 73 of the back support 60, and such material then tends to flow radially outwardly to form the annular bead 38 which reliably locks the shank 36 to the male component 10. The shank 36 then resembles a mushroom and overlies the radially innermost portion of the inner side 15 of the male component 10. The bead 38 may but need not extend all the way to the convex inner flank of the male coupling element 12. The flat end face 39 of the mushroom-shaped (deformed) shank 36 is sufficiently close to the inner side 15 to provide room for the mushroom-shaped shank of the other connector 30 when the male component 10 of FIG. 12 is assembled with a female component 20 in a manner as shown in FIG. 8, i.e., the axial length of each mushroom-shaped (deformed) shank 36 is selected with a view to ensure that such shanks cannot contact each other and thus cannot interfere with attachment of the male and female components 10, 20 to each other.

The annular surface 72 in the groove 71 of the end face 69 of the back support 60 performs the important and desirable function of preventing deformation of the male coupling element 12 in a direction toward the axis of the aperture 14 when the end face 69 of the back support 60 engages the adjacent side of the male component 10 as well as during subsequent deformation of the shank 36 to convert the pointed tip 37 into the bead 38 and the adjacent cylindrical portion as shown in FIGS. 8 and 12. Absence of deformation of the male coupling element 12 is important because this ensures that the element 12 can be properly engaged with a female coupling element 22 as well as that such engagement and (if necessary) a subsequent disengagement does not necessitate the application of excessive forces. Still further, the surface 72 in the groove 71 of the end face 69 of the back support 60 renders it possible to make the male components 10 of a readily available inexpensive synthetic plastic material whose resistance to permanent deformation is just sufficient to ensure adequate engagement between the male and female coupling elements 12 and 22.

The projections 33 at the concave inner side 32 of the head 31 of the connector 30 penetrate into the material of the carrier 70 when the upper tool 40 reaches the lower end position of FIG. 12. The convex outer side 16 of the male component 10 then bears against the upper side of the carrier 70 opposite the concave inner side 32 of the head 31. As mentioned above, the projections 33 hold the connector 30 against rotation relative to the carrier 70.

The sleeve-like tubular confining member 58 of the lower tool 50 performs the following functions: The marginal portion of the head 31 of the connector 30 in the socket 53 of the lower tool 50 would be likely to penetrate into and leave a permanent mark in or even destroy the adjacent portion of the carrier 70. The ram 54 cannot contact the carrier 70 because it does not extend radially beyond the head 31 of the connector 30 in the socket 53. The upper end face **58*b* of the confining member 58 is flush with the upper side of the marginal portion of the head 31 when the confining member 58 assumes the upper end position of FIG. 9, 10, 11 or 12. The end face 58*b* is flat and thus prevents the formation of a pronounced circular mark in and/or more serious damage to the material of the carrier 70 in the region where the carrier is adjacent to the radially outermost portion of the head 31. Moreover, the confining member 58 reliably centers the head 31 in the socket 53 to thereby ensure that the shank 36 is in register with the aperture 14 of the male component 10 which is held by the jaws 42 and which is thereupon expelled from the chamber 65 and assumes the position of FIG. 11 (at a level below the jaws 42). The confining member 58 can yield against the opposition of the coil spring 59 whenever the need arises to even further reduce the likelihood of permanent deformation of or even more pronounced damage to the adjacent portion of the carrier 70. The direction in which the confining member 58 can yield against the opposition of the spring 59 is indicated by the arrows 76 (see FIG. 12). Yieldability of the confining member 58 is desirable and advantageous because this ensures that the end face 58*b* cannot leave a permanent impression in the adjacent portion of the carrier 70. The fact that the end face 58*b* of the confining member 58 moves to a level below the upper side of the head 31 in the socket 53 when the coil spring 59 is caused to store energy is of no consequence insofar as the centering action of the confining member 58 upon the connector 30 in the socket 53 is concerned because the shank 36 has already penetrated into the aperture 14 of the male component 10 when the spring 59 begins to yield and permits movement of the end face 58*b* to a level below the uppermost portion of the head 31 in the socket 53**.

The length of the stroke of the gripper 41 of the upper tool 40 between its upper and lower end positions is shown at 68 (FIG. 9).

When the conversion of the shank 36 into the mushroom-shaped body of FIG. 12 is completed, the tool 40 is returned to its upper end position whereby the aforediscussed spring or springs automatically return the platform 51 to the upper end position of FIG. 9. During the first stage of return movement of the parts of the tool 40 to the positions of FIG. 9, the dished springs of the package 102 are permitted to dissipate energy and to thus lift the deforming member 45 with reference to the ring-shaped back support 60 whereby the pin 49 returns into the uppermost portion of the elongated slot 62 in the extension 61 of the back support 60. The upward movement of the deforming member 45 with reference to the back support 60 is followed by upward movement of the gripper 41 and back support. The latter begins to rise as soon as the pin 49 reaches the upper end portion of the slot 62 and the deforming member 45 continues to move upwardly. Upward movement of the back support 60 and gripper 41 entails that the coil spring 59 for the confining member 58 is free to expand (provided that the confining member 58 was moved from its upper end position with reference to the stationary ram 54 of the lower tool 50) and the platform 51 is also free to rise to the upper end position of FIG. 9. This completes a cycle and the carrier 70 is then removed and replaced with a different carrier or is shifted relative to the supporting surface 51*a* of the platform 51 so that another predetermined (preferably marked) portion of such carrier overlies the socket 53 and is ready to be traversed by the shank 36 of a fresh connector 30 which is to be coupled to a male component 10 or to a female component 20.

The manner in which a female component 20 is introduced into the chamber 54 between the jaws 42 of the gripper 41 is the same as the manner of introducing a male component 10. The difference is that the blocking pin 94 then extends into the aperture 14 of the adjacent male component 10 in the channel of the rail 85 so that the feeding unit 81 is ineffective but the feeding unit 82 is free to admit discrete female components 20 into the channel of the receiving device 84 at the rate which is determined by the frequency of movement of the delivering means (pusher 87) to the retracted position of FIG. 14 or 15.

Figure 13:
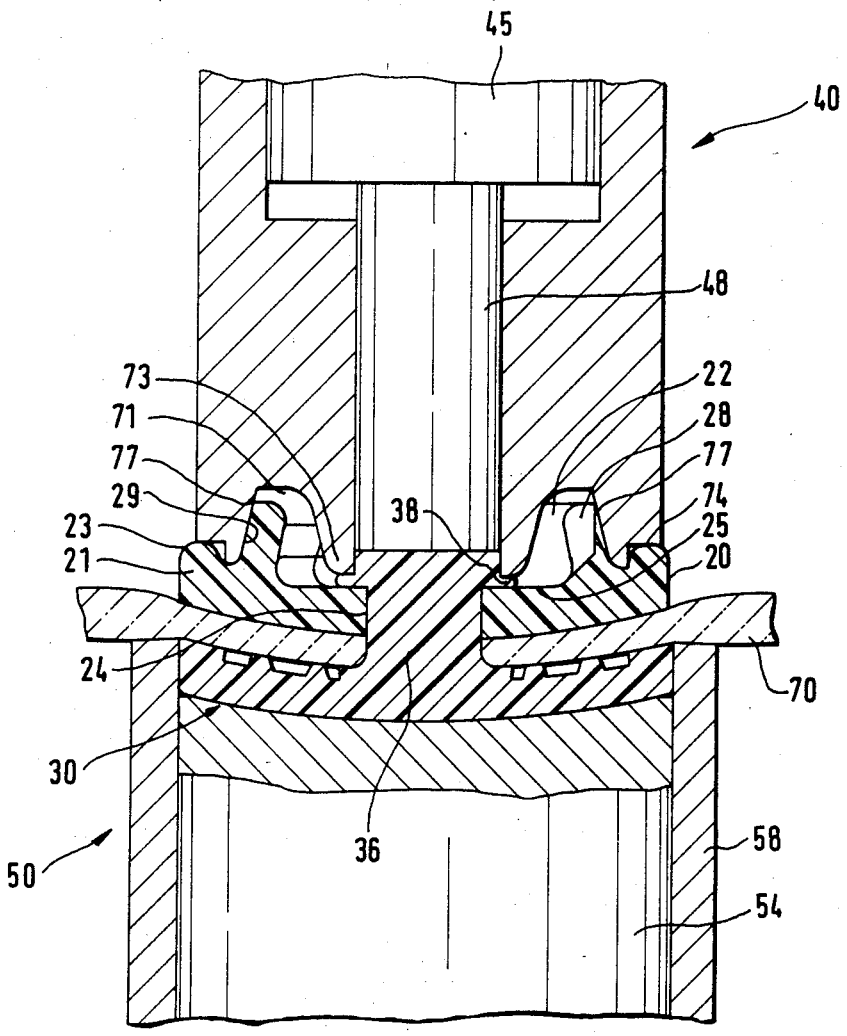
FIG. 13 is a similar view but showing the upper tool in extended position subsequent to attachment of a connector to a female component which abuts against the end face of the ring-shaped back support of the upper tool.

Once a female component 20 is properly received in the chamber 65, the upper tool 40 descends to the intermediate position of FIG. 10 so that the lower end face 69 of the back support 60 engages and centers the female component in a manner as best shown in FIG. 13. Thus, the annular portion 73 is surrounded by the composite female coupling element 22 which extends into the groove 71 and whose conical outer flank 29 abuts against the annular outer surface 77 in the groove 71 to thus prevent deformation of the female coupling element 22 in a direction radially of and away from the axis of the central aperture 24. The recess 74 in the end face 69 receives the bead 23 of the outer marginal portion 21 of the female component 20 to even further reduce the likelihood of misalignment of this component with reference to the connector 30 in the socket 53 of the lower tool 50.

The parts of the upper tool 40 then assume the intermediate positions of FIG. 11 whereby the shank 36 of the connector 30 in the socket 53 penetrates through the carrier 70 which overlies the surface 51*a* of the platform 51 and enters the central aperture 24 of the female component 20 at the underside of the back support 60. The tool 40 thereupon assumes the lower end position of FIG. 13 whereby the working end 48 of the deforming member 45 upsets the tip of the shank 36 to form the bead 38 which overlies the inner side 25 of the female component 20 in immediate proximity of the aperture 24.

The slots 28 of the female coupling element 22 enhance the tendency of the arcuate sections of this coupling element to move apart. Since the female component 20 is preferably made of a deformable synthetic plastic material, the sections of the female coupling element 22 could move apart and would prevent adequate engagement with the coupling element 12 of a male component 10 as a result of excessive or pronounced deformation of the tip of a shank 36 which extends through the aperture 24 of the female component 20 at the underside of the back support 60. The annular outer surface 77 in the groove 71 of the end face 69 of the back support 60 prevents such undesirable deformation of the female coupling element 22 so that one and the same upper tool 40 can adequately hold and attach male components 10 and/or female components 20 by the simple expedient of providing the end face 69 of the back support 60 with a groove 71 which is bounded in part by the annular surface 72 (which prevents undesirable deformation of male coupling elements 12) and in part by the annular surface 77 (which prevents undesirable deformation of the arcuate sections of female coupling elements 22).

The aforedescribed configuration of the male components 10, female components 20 and connectors 30 renders it possible to use a single type of connectors 30 for attachment to the male components 10 or to the female components 20 with the same degree of reliability and by utilizing a single set of confronting tools 40 and 50. The ability of the male and female coupling elements 12, 22 to adequately engage each other is not affected by the fact that the same tool (40) is used for application of male or female components to selected portions of a single carrier or to different carriers. Furthermore, the mechanical connection between a connector 30 and a male component 10 is just as reliable as that between a connector 30 and a female component 20. The reliability of attachment of the male or female components 10 and 20 to a single piece of fabric or to different carriers is not affected by the frequency at which the activating or control unit 98 is operated to shift from the application of male components 10 to the application of female components 20 or vice versa.

The back support 60 not only ensures that the male coupling elements 12 or female coupling elements 22 are not deformed during attachment of the respective male or female components to a carrier but the back support also prevents undue deformation of the remaining portions of male or female components. This is due to the fact that the beads 13 or 23 of the outer marginal portions 11 or 21 are received in the annular recess 74 of the end face 69 at the underside of the back support 60 so that the latter props the adjacent component 10 or 20 at two radially spaced apart circumferentially complete locations. The back support 60 further ensures predictable deformation of the shanks 36 because its annular portion 73 controls the direction of cold flow of the material of a pointed tip 37 which is being deformed by the working end 48 of the member 45 during the last stage of movement of the tool 40 to its lower end position. This enhances the reliability of the connection between a male or female component and the corresponding connector 30 and contributes to the establishment of identical connections irrespective of whether the connectors 30 are to be affixed to male components 10 or female components 20. Still further, the back support 60 ensures that the height of deformed shanks 36 is not excessive, i.e., (and as already described with reference to FIG. 8) that the deformed shanks 36 of two connectors 30 in a fully assembled article of hardware remain spaced apart from each other and thus cannot interfere with attachment of the male coupling elements 12 to the female coupling elements 22.

It is clear that each of the various parts of the upper tool 40 and/or lower tool 50 can receive motion from a discrete drive. The illustrated arrangement is preferred at this time because it contributes to simplicity, compactness and lower cost of the machine. Thus, the extent of reciprocatory movement of the platform 51 can be controlled by the parts of the upper tool, the extent of axial movement of the confining member 58 relative to the fixed ram 54 can be controlled by the material of the carrier 70, the extent of movability of the back support 60 relative to the deforming member 45 and/or vice versa can be controlled by a simple pin-and-slot connection 49, 62, and the opening and closing of the gripper 41 can be controlled by a component 10 or 20 and by the back support 60.

The utilization of components 10, 20 with convex outer sides 16, 26 and of connectors 30 whose heads 31 have concave inner sides 32 is desirable and advantageous because this contributes to more reliable retention of carriers 70 between such parts as well as to more accurate and predictable orientation of the connectors and male or female components relative to each other.

The concentric grooves 27 in the convex outer sides 26 of the female components 20, the concentric grooves 17 in the convex outer sides 16 of the male components 10 and/or the protuberances 35 at the convex outer sides 34 of the heads 31 of connectors 30 can serve a purely decorative purpose. Such grooves and protuberances are optional (see FIG. 8).

FIG. 21 shows certain parts of a modified machine 75 which can utilize the confronting tools 40, 50 of FIGS. 9 to 13 but which is capable of supplying to the tool 40 two or more different types of male components 10, 10' and/or two or more different types of female components 20, 20'. Furthermore, the machine of FIG. 21 can supply to the tool 50 two or more different types of connectors 30, 30'. For example, the male components 10, 10' can consist of different (e.g., metallic and plastic) materials or they may be furnished in different colors. The same applies for the female components 20, 20' and for the connectors 30, 30'.

The sources 105, 105' of male components 10, 10' are two discrete magazines or two compartments of a single magazine. Analogously, the sources of female components 20, 20' include two discrete magazines 109, 109' or two compartments of a single magazine. The sources of connectors 30, 30' are two discrete magazines 113, 113' or two compartments or chambers of a single magazine.

Feeding units 106 and 106' are provided to advance discrete rows of male components 10, 10' from the respective magazines 105, 105' to a junction 107 where the feeding units 106, 106' merge into the aforementioned feeding unit 81 including the channeled guide rail 85. A barrier or gate 108 (indicated schematically by an arrow) is provided at the junction 107 to shift a suitable switching device between a first position in which the feeding unit 106 can deliver male components 10 to the feeding unit including the rail 85 and a second position in which the feeding unit including the rail 85 receives male components 10' from the feeding unit 106'. The barrier 90 at the discharge end of the feeding unit including the rail 85 performs the same function as the barrier 90 of FIGS. 19 and 20, i.e., it permits only the male components 10 or 10' or the female components 20 or 20' to reach the chamber 65 between the jaws 42 of the gripper 41 forming part of the tool 40.

The magazines 109, 109' respectively admit single rows of properly oriented female components 20, 20' into the feeding units 110, 110' which merge into the feeding unit 82 including the rail 86 at a junction 111 provided with a barrier or gate 112 performing the same function as the gate or barrier 108, i.e., to admit into the channel of the rail 86 female components 20 which are supplied by feeding unit 110 or female components 20' which are supplied by the feeding unit 110'. The feeding unit including the rail 86 extends from the junction 111 to the tool 40, and the gravitational descent of female components 20 or 20' therein is controlled by the barrier 90 in the same way as described in connection with FIGS. 19 and 20.

It is clear that the machine of FIG. 21 can have three or more discrete sources of different male components 10, 10', etc. and one, two, three or more discrete sources of female components 20, 20', etc. or vice versa. The provision of three or more sources of male components necessitates the use of a more complex barrier or gate 108 at the junction of feeding units which receive male components from three or more different sources, and the same holds true if the machine of FIG. 21 is equipped with three or more sources of different female components. By way of example, the structure which is shown in the right-hand portion of FIG. 21 can be duplicated so that the machine 75 then comprises four discrete sources of male components and four discrete sources of female components. The second barrier 90 is or can be provided diametrically opposite the illustrated barrier 90, i.e., the chamber 65 of the gripper forming part of the tool 40 which is shown in the lower portion of FIG. 21 can receive male components 10 or 10' or female components 20 or 20' from its right-hand side, and such chamber can receive additional types of male or female components from its left-hand side, as viewed in FIG. 21.

The sources 112, 113' admit single rows of properly oriented connectors 30, 30' into the channels of two discrete feeding units 83, 83' which merge at the junction 114 and are controlled by a gate or barrier 115 corresponding to the barrier 108 or 112, i.e., the socket 53 of the lower tool 50 can receive connectors 30 or connectors 30' depending on the position or condition of the switching device or blocking means which is controlled by the barrier 115.

The machine of FIG. 21 can be equipped with a single source of connectors (e.g., connectors 30) or with three or more sources each of which contains a supply of different connectors. For example, the structure which is shown in the left-hand portion of FIG. 21 can be duplicated to provide a total of four discrete sources of different connectors, four feeding units and two barriers or gates 115 as well as a further barrier (corresponding to the barrier 90) which determines the type of connectors that are actually admitted into the socket 53.

The primary reason (or an important reason) for providing the improved machine with two or more sources of male components, female components and/or connectors is to allow for the application of differently colored components or connectors and/or to allow for the admission of components or connectors which are made of different types of plastic and/or metallic material.

The exact nature of control means for the various barriers or gates of the machine 75 which is shown in FIG. 21 forms no part of the present invention. Such control means can constitute or include a suitable circuit which receives signals indicating the need for a particular type of male or female components or connectors, and the circuit then transmits appropriate signals to the barriers or gates 108, 112, 90 and 115 to ensure the selection of desired male or female components and/or connectors. The circuit can receive input signals from a control panel or automatically in accordance with a selected program.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for selectively applying centrally apertured annular male and female components of fasteners to penetrable carriers by means of connectors of the type having a rivet head and a deformable shank extending from one side of the head, comprising confronting first and second tools; means for moving at least one of said tools relative to the other of said tools between a retracted position in which a carrier is insertable between the tools and an extended position, said first tool having a socket for reception of the heads of discrete connectors in such orientation that the shank of the connector in said socket extends toward said second tool and penetrates through the carrier between said tools on movement of said one tool toward said extended position, said second tool having gripper means for releasably holding a male or female component in such orientation that the aperture of the component held by said gripper means registers with and receives the shank of the connector in said socket in response to movement of said one tool toward said extended position, said second tool further having a deforming member movable with reference to said gripper means during movement of said one tool toward said extended position so as to deform the shank of the connector in said socket subsequent to penetration of such shank first through the carrier between said tools and thereupon through and partially beyond the aperture of the component which is held by said gripper means; means for introducing discrete connectors into said socket in the retracted positions of said one tool; and means for delivering discrete male or female components to said gripper means in the retracted positions of said one tool.

2. The machine of claim 1, wherein said second tool further comprises a back support arranged to hold down the component which is held by said gripper means during penetration of the shank of a connector through and partly beyond the aperture of such component and during subsequent deformation of the shank.

3. The machine of claim 2 for applying male and female components of the type having at least substantially identically dimensioned outer marginal portions engageable by said gripper means and respectively having annular male and female coupling elements facing away from said first tool and being contacted by said back support while the respective marginal portions are held by said gripper means, wherein said first tool includes a platform having a supporting surface for the carrier, said socket being provided in said platform and said first tool further including a ram surrounded by said platform and having a surface arranged to contact the other side of the head of the connector in said socket, said platform being movable relative to said ram to thereby vary the distance between the surface of said platform and the surface of said ram.

4. The machine of claim 2, further comprising a source of connectors, means for feeding discrete connectors from said source into the range of said introducing means, at least one source of male components, at least one source of female components, and means for selectively feeding male and female components from the respective sources into the range of said delivering means.

5. The machine of claim 2, wherein said gripper means comprises a tongs having jaws which are movable nearer to and further away from each other to respectively hold and release a component which is placed between said jaws by said delivering means, said deforming member being reciprocable with reference to said jaws and having a front end face arranged to deform the shank of a connector while such shank extends partially beyond the aperture of the component which is held down by said back support.

6. The machine of claim 2, wherein said back support comprises a ring and said deforming member is reciprocable axially of and within the confines of said ring, said ring being movable within limits axially of said deforming member and having an annular end face which contacts the component that is held by said gripper means during movement of said one tool toward said extended position so that the end face surrounds the aperture of such component.

7. The machine of claim 6 for applying male and female components of the type having at least substantially identically dimensioned outer marginal portions engageable by said gripper means and respectively having annular male and female coupling elements facing away from said first tool while the respective marginal portions are held by said gripper means, wherein the end face of said ring has an annular groove bounded by a first and a second annular surface, the male coupling element of the male component which is held by said gripper means being in contact with one of said first and second surfaces during movement of said one tool toward said extended position and the female coupling element of the female component which is held by said gripper means being in contact with the other of said first and second surfaces during movement of said one tool toward said extended position.

8. The machine of claim 7, wherein said first annular surface surrounds said second annular surface and the female coupling element of a female component which is held by said gripper means is in contact with said first annular surface while said one tool moves toward said extended position.

9. The machine of claim 7, wherein the end face of said ring has an annular recess which receives the marginal portion of the male or female component held by said gripper means.

10. The machine of claim 2, wherein said first tool is disposed at a level below said second tool and further comprising at least one source of male components, at least one source of female components, means for feeding male components from the respective source into the range of said delivering means, means for feeding female components from the respective source into the range of said delivering means, and means for inactivating one of said feeding means while the other feeding means is in the process of feeding the respective components and vice versa.

11. The machine of claim 2, further comprising at least one source of male components, at least one source of female components, means for receiving components from either of said sources and means for blocking the admission of components from one of said sources to said receiving means while the receiving means accepts components from the other of said sources and vice versa.

12. The machine of claim 11, wherein said receiving means has a channel for reception of components from the selected source and said delivering means is arranged to transfer components from said channel to said gripper means.

13. The machine of claim 2, wherein said first tool includes a platform having a supporting surface for the carrier and surrounding said socket, a ram surrounded by said platform and having a surface arranged to contact the other side of the connector in said socket, substantially tubular confining means axially movably surrounding said ram and means for yieldably biasing said confining means in a direction toward said second tool to a position in which the confining means extends beyond the surface of said ram and surrounds the connector in said socket.

14. The machine of claim 2, wherein said back support includes a ring having an end face which contacts the component held by said gripper means while said one tool moves toward said extended position, said deforming member being reciprocable within said ring and further comprising means for limiting the extent of movability of said ring and said deforming member relative to each other.

15. The machine of claim 14, further comprising means for yieldably biasing said ring in a direction toward said first tool so that the ring normally assumes a predetermined end position with reference to said deforming member in which the latter is spaced apart from the component held by said gripper means.

16. The machine of claim 2, further comprising several sources of different connectors and means for feeding connectors from a selected source into the range of said introducing means.

17. The machine of claim 16, further comprising means for blocking the admission of connectors from all but the selected source of connectors.

18. The machine of claim 17, wherein said feeding means includes a discrete feeding unit for each of said sources and means for receiving connectors from the selected source, said introducing means being arranged to transfer connectors from said receiving means into said socket.

19. The machine of claim 18, wherein said receiving means has a channel which is dimensioned to receive connectors from any one of said sources.

20. The machine of claim 2 for applying male and female components of the type having a convex side facing said first tool, while a component is held by said gripper means, by means of connectors with heads the one side of which is concave, said second tool being disposed at a level above said first tool.

21. The machine of claim 1, further comprising at least two sources of different male or female components, at least one additional source of female or male components, discrete component feeding means for each of said sources, means for receiving components from said feeding means, and means for activating one of said feeding means at a time so that said receiving means is supplied with components from one of said two sources or from said additional source.

22. The machine of claim 21, wherein each of said feeding means includes means for singularizing the respective components and for supplying to said receiving means one component at a time.

* * * * *